US010697238B2

(12) United States Patent
Era

(10) Patent No.: US 10,697,238 B2
(45) Date of Patent: Jun. 30, 2020

(54) TELESCOPIC DEVICE

(71) Applicant: PiCa Corp., Higashi-Osaka-shi, Osaka (JP)

(72) Inventor: Osamu Era, Higashi-Osaka (JP)

(73) Assignee: PICA CORP., Higashi-Osaka-Shi, Osaka (JP)

( * ) Notice: Subject to any disclaimer, the term of this patent is extended or adjusted under 35 U.S.C. 154(b) by 0 days.

(21) Appl. No.: 15/556,240

(22) PCT Filed: Aug. 31, 2016

(86) PCT No.: PCT/JP2016/075468
§ 371 (c)(1),
(2) Date: Sep. 6, 2017

(87) PCT Pub. No.: WO2017/038866
PCT Pub. Date: Mar. 9, 2017

(65) Prior Publication Data

US 2018/0238112 A1 Aug. 23, 2018

(30) Foreign Application Priority Data

Sep. 4, 2015 (JP) ..... 2015-174629
Sep. 4, 2015 (JP) ..... 2015-174630
May 12, 2016 (JP) ..... 2016-096169

(51) Int. Cl.
*E06C 1/22* (2006.01)
*E06C 7/06* (2006.01)
(Continued)

(52) U.S. Cl.
CPC ..... *E06C 7/06* (2013.01); *E06C 1/22* (2013.01); *E06C 1/39* (2013.01); *E06C 7/44* (2013.01); *E06C 1/12* (2013.01); *E06C 7/42* (2013.01)

(58) Field of Classification Search
CPC ..... E06C 1/22; E06C 1/39; E06C 7/44
See application file for complete search history.

(56) References Cited

U.S. PATENT DOCUMENTS 5,074,378 A * 12/1991 Studer ..... E06C 1/22 182/166
8,113,316 B2 * 2/2012 Sward ..... G01N 33/497 108/62
(Continued)

FOREIGN PATENT DOCUMENTS

CN 2677575 Y 2/2005
CN 2839540 Y 11/2006
(Continued)

OTHER PUBLICATIONS

International Search Report for PCT/JP2016/075468 (PCT/ISA/210) dated Oct. 25, 2016.
(Continued)

*Primary Examiner* — Alvin C Chin-Shue
(74) *Attorney, Agent, or Firm* — Birch, Stewart, Kolasch & Birch, LLP

(57) ABSTRACT

A telescopic device achieves both simultaneous unlocking of paired locking units and easy unlocking of one locking unit, and includes: outer casings; insertion bodies; vertically-arranged rung members; a locking mechanism; and an operating mechanism having an operating member. The locking mechanism comprises retention portion of the insertion body and locking member supported on the outer casing for engagement with and disengagement from the retention portion by separating-approaching motion. The locking member is interlocked to operating member extending from the locking mechanism toward the upper rung member. The operating mechanism has an operating rod for coupling the paired operating members for concurrent movements in unlocking direction. Each end of the operating rod and one
(Continued)

operating member are fitted together so that, when manipulating one end of the operating rod in unlocking direction, the operating rod is inclined for movement of one operating member in unlocking direction.

8 Claims, 17 Drawing Sheets

(51) Int. Cl.

| | |
|---|---|
| ***E06C 1/39*** | (2006.01) |
| ***E06C 7/44*** | (2006.01) |
| *E06C 1/12* | (2006.01) |
| *E06C 7/42* | (2006.01) |

(56) References Cited

U.S. PATENT DOCUMENTS

| | | | | |
|---|---|---|---|---|
| 2010/0071996 | A1* | 3/2010 | Huang | E04G 1/34 182/118 |
| 2011/0011678 | A1 | 1/2011 | Sheffield | |

FOREIGN PATENT DOCUMENTS

| | | | |
|---|---|---|---|
| JP | 60-72900 | U | 5/1985 |
| JP | 6-6699 | U | 1/1994 |
| JP | 8-158767 | A | 6/1996 |
| JP | 11-193682 | A | 7/1997 |
| JP | 10-292760 | A | 11/1998 |
| JP | 11-22351 | A | 1/1999 |
| JP | 2001-32520 | A | 2/2001 |
| JP | 2005-61033 | A | 3/2005 |
| JP | 2006-52851 | A | 2/2006 |
| JP | 2012-193561 | A | 10/2012 |
| JP | 2013-181343 | A | 9/2013 |
| WO | WO 2007/148331 | A2 | 12/2007 |

OTHER PUBLICATIONS

Extended European Search Report, dated Sep. 18, 2018, for European Application No. 16841896.0.

* cited by examiner

TELESCOPIC DEVICE

TECHNICAL FIELD

The present invention relates to a telescopic device for use in a telescopic support of a ladder or a stepladder, for example.

BACKGROUND ART

For example, there is a telescopic device for use in a stepladder support comprising a pair of telescoping bodies each comprising an outer casing and an insertion element which is telescopically inserted in the outer casing, and has its tip made capable of placement on a ground surface. In this construction, the outer casings of the telescoping bodies are coupled in spaced relation to each other via rung members, and, each outer casing is provided with a locking mechanism for securely holding the insertion element in telescoped position, and an operating member for unlocking the locking mechanism, and also, in between the paired operating members, there is provided operating means for simultaneous manual operation of the paired operating members.

In a conventional telescopic device of this type, as disclosed in Patent Literature 1, a conducting element such as a wire is coupled to an unlocking lever (operating member) of one locking mechanism, is passed through the interior of a tube, is passed through the interior of a flexible operating lever accommodated at the back side of a top plate, is passed through another tube, and is coupled to an operating member of the other opposed locking mechanism, and, the operating lever accommodated at the back side of the top plate of a stepladder constitutes the operating means for simultaneous manual operation of the paired operating members. A user carries out simultaneous unlocking operation of the paired locking mechanisms standing up while holding the stepladder with his/her hands.

Moreover, in such a construction as disclosed in Patent Literature 2, in order for a locking mechanism mounted at a lower part of a support to be locked and unlocked from above the support, the locking mechanism is disposed inside an insertion element, and also a long operating member for operation of the locking mechanism is disposed inside the insertion element.

Furthermore, in such a construction as disclosed in Patent Literature 3, a locking mechanism mounted at an outer casing comprises: a locking member for locking an insertion element; a handle; a pivotal portion disposed at one end of the handle for supporting the locking member, the pivotal portion being piercingly supported in a pair of side walls of a support frame for axial movement; and a latching portion disposed at the other end of the handle for rocking the locking member. In this construction, the handle is supported for movement in a direction perpendicular to a rocking direction relative to the support frame, and, the support frame has formed in its side wall a latching hole which receives the latching portion. By operating the handle to move so that the latching portion is fitted in the latching hole during the time the insertion element is locked by the locking member, it is possible to restrain the handle, the locking member, and their included components against rocking motion, and thereby prevent the locking member from rocking for disengagement.

PRIOR ART REFERENCE

Citation List

Patent Literature 1: Japanese Unexamined Patent Publication JP-A 2005-61033

Patent Literature 2: Japanese Unexamined Utility Model Publication JP-U 6-6699 (1994)

Patent Literature 3: Japanese Unexamined Patent Publication JP-A 2006-52581

SUMMARY OF INVENTION

Technical Problem

However, according to the technologies disclosed in Patent Literature 1, although the paired supports and so forth can be telescopically adjusted with ease by simultaneous unlocking operation of the paired locking mechanisms through actuation of the operating members from a remote location, it is difficult to unlock only one of the locking mechanisms for telescoping adjustment of corresponding one of the telescoping bodies alone. Due to lack of easiness in telescoping adjustment of one of the telescoping bodies alone, for example, when placing the stepladder or the like on a slant or uneven ground surface, it is difficult to adjust the paired telescoping bodies to telescope into different lengths for quick and stable placement of the stepladder or the like on a slant or uneven ground surface.

Furthermore, according to the technologies disclosed in Patent Literature 2, although the paired locking mechanisms can be operated on an individual basis from a remote location by actuating the long operating member, it is difficult to effect simultaneous operation of the paired locking mechanisms. In many cases, the insertion element to be telescopically inserted into the outer casing is constructed of a tubular element from the standpoint of strength. However, in the conventional construction, the locking mechanism is disposed inside the insertion element, and the long operating member for operation of the locking mechanism is also disposed inside the insertion element. This makes impossible the use of a tubular element for the insertion element, wherefore the insertion element has to be constructed of a channel member, for example. This presents the problem of poor strength in the insertion element, and, to enhance the strength of the insertion element, the insertion element needs to be made thick, or needs to be provided with a reinforcement member.

In addition, according to the technologies disclosed in Patent Literature 3, for lack of means for effecting unlocking operation of the locking member from a remote location, it is necessary to follow a step of rocking the handle to fit the locking member to the insertion element, and a subsequent step of moving the handle in a direction perpendicular to the rocking direction to engage the engagement portion in the engagement hole. As another problem, to detach the locking member from the insertion element, it is necessary to follow a step of moving the handle in a direction perpendicular to the rocking direction to release the engagement of the engagement portion with the engagement hole, and a subsequent step of rocking the handle to disconnect the locking member from the insertion element, with the consequence that much time and efforts will be required for telescoping adjustment operation.

The present invention aims at providing a telescopic device capable of solving the problems associated with the conventional art as discussed supra.

An object of the present invention is to provide a telescopic device capable of not only simultaneous unlocking operation of a pair of locking units but also easy unlocking operation of one of the locking units alone for easy and quick telescoping adjustment of both of or one of paired telescoping bodies.

Another object of the present invention is to provide a telescopic device capable of prevention of rocking motion of a locking member for disengagement and easy telescoping adjustment operation.

Still another object of the present invention is to provide a telescopic device having an insertion body constructed of a tubular body which affords an advantage in strength, and an operating member which is long and yet will not constitute any obstruction to operation.

Solution to Problem

The following describes specific means for the present invention to solve the problems.

According to the first aspect of the present invention, there is provided a telescopic device comprising: a pair of outer casings 8; insertion bodies 9 telescopically inserted one in each of the outer casings 8; a plurality of vertically-arranged rung members 6 each providing a connection between the paired outer casings 8; a locking mechanism 7 mounted at each of the outer casings 8 for securely holding the insertion body 9 in telescoped position relative to the outer casing 8; and operating means 93 having an operating member 69 for unlocking each of the locking mechanisms 7. Each of the locking mechanisms 7 comprises a retention portion 11 disposed at the insertion body 9 and a locking member 23 supported on the outer casing 8 in movable relation toward and away from the retention portion 11 for engagement with and disengagement from the retention portion 11. The locking member 23 serves as a telescopic system interlocked to the operating member 69 extending from the locking mechanism 7 to a position near the upper rung member 6. The operating means 93 comprises an operating rod 96 for coupling the paired operating members 69 for concurrent movements in an unlocking direction. Each end of the operating rod 96 and corresponding one of the paired operating members 69 are fitted to each other in a manner such that, when manipulating one end of the operating rod 96 in an unlocking direction, the operating rod 96 is inclined with consequent movement of one of the operating members 69 alone in the unlocking direction.

According to the second aspect of the present invention, the operating means 93 comprises an engagement portion 94 disposed at an upper part of each of the operating members 69 and a linkage portion 95 disposed at each end of the operating rod 96 in engageable relation to the engagement portion 94. In between one of the linkage portions 95 and the corresponding engagement portion 94, as well as in between the other one of the linkage portions 95 and the corresponding engagement portion 94, there is left a play for movement of the linkage portion 95 from a position out of engagement with the engagement portion 94 to a position in engagement with the engagement portion 94.

According to the third aspect of the present invention, the rung member 6 in the vicinity of an upper part of the operating member 69 has a downwardly-opening recess 19, and, the operating rod 96 is placed inside the recess 19 so as to be oriented parallel to a direction of length of the rung member 6, and can thus be manually operated from below the rung member 6.

According to the fourth aspect of the present invention, opposing sides of the paired outer casings 8 are each formed with a vertically-elongated opening slot 10, and, the telescoping body 5 is formed with a retention portion 11 located in corresponding relation to the opening slot 10. The operating member 69 is vertically oriented along the opening slot 10. The opposing sides of the paired outer casings 8 are each formed with an insertion space 21 for guiding the operating member 69 in movement between the outer casing and an end of the rung member 6, and a guide member 77 for guiding a lower part of the operating member 69 in movement.

According to the fifth aspect of the present invention, the locking mechanism 7 comprises: a support frame 18 secured to the outer casing 8 for housing the locking member 23; a pivot shaft 24 supported on the support frame 18 to support the locking member 23 for rocking motion in movable relation toward and away from the retention portion 11; and a handle 25 situated externally of the support frame 18 to rock the locking member 23 via the pivot shaft 24.

According to the sixth aspect of the present invention, the support frame 18 is provided with: a linkage tool 27 interlocked to the operating member 69 while being supported for movement between a locking position X and an unlocking position Y; linkage means 29 which brings the locking member 23 into engagement with the insertion body 9 when the linkage tool 27 is moved to the locking position X, and releases the engagement of the locking member 23 with the insertion body 9 when the linkage tool 27 is moved to the unlocking position Y; and disengagement preventive means 30 which inhibits the locking member 23 from rocking motion for disengagement when the linkage tool 27 is moved to the locking position X, and permits the locking member 23 to rock for disengagement when the linkage tool 27 goes out of the locking position X.

According to the seventh aspect of the present invention, the linkage means 29 comprises: an operation piece 55 formed in protrusion form in the locking member 23, the operation piece 55 being pressed into movement in response to a movement of the linkage tool 27; and a first press-moving piece 58 and a second press-moving piece 59, each formed in protrusion form in the linkage tool 27, arranged so as to have sandwiched therebetween the operation piece 55 in a direction of movement of the linkage tool 27. The linkage means 29 is designed so that, when the linkage tool 27 is moved to the locking position X, the first press-moving piece 58 presses the operation piece 55 into movement to rock the locking member 23 in an engaging direction, whereas, when the linkage tool 27 is moved to the unlocking position Y, the second press-moving piece 59 presses the operation piece 55 into movement to rock the locking member 23 in a disengaging direction. The disengagement preventive means 30 comprises: a pressing portion 54 disposed at a rocking end of the locking member 23 so as to protrude toward the linkage tool 27; and a restraint portion 60 disposed in the linkage tool 27 so as to protrude toward the pressing portion 54. The disengagement preventive means 30 is designed so that, when the linkage tool 27 is moved to the locking position X, the pressing portion 54 and the restraint portion 60 confront each other, whereas, when the linkage tool 27 goes out of the locking position X, the restraint portion 60 is displaced from a position of confrontation with the pressing portion 54. Moreover, an idle clearance 65 is left between the second press-moving piece 59 and the operation piece 55 to allow the locking member 23 to start to rock for disengagement after a removal of the restraint portion 60 away from the pressing portion 54 when the linkage tool 27 is moved from the locking position X to the unlocking position Y.

According to the eighth aspect of the present invention, an urging member 91 is provided to urge the linkage tool 27 toward the locking position, and, the handle 25 comprises: a grip 41 coupled at one end to the pivot shaft 24; and an operation portion 42 extended from the other end of the grip 41 toward the linkage tool 27.

and wherein disposed between the grip 41 and the linkage tool 27 is linkage tool press-moving means 67 for pressing the linkage tool 27 into movement to the unlocking position Y against an urgence exerted by the urging member 91 by turning the handle 25 about the pivot shaft 24.

According to the ninth aspect of the present invention, the insertion space 21 for the operating member 69 is formed between an outer face of the outer casing 8 and an end of the rung member 6, and, the guide member 77 is disposed on that part of the outer face of the outer casing 8 which is close to the locking mechanism 7. The operating member 69 is arranged so as to be guided through the insertion space 21 by the guide member 77 into movement along the outer face of the outer casing 8.

According to the tenth aspect of the present invention, a coupler 82 for interlocking the operating member 69 and the locking member 23 is guided by the guide member 77, and, disposed between the coupler 82 and the guide member 77 is a spring 90 for urging the coupler 82 in a locking direction relative to the guide member 77.

According to the eleventh aspect of the present invention, two sets of components are arranged face to face each other, each set comprising: the paired outer casings 8; the insertion bodies 9 inserted one in each of the outer casings 8; a plurality of the vertically-arranged rung members 6; the locking mechanism 7 situated near the lowermost rung member 6; and the operating means 93 having the operating rod 96 situated near the uppermost rung member 6, and, the two sets are foldably coupled to each other at upper parts of their outer casings 8 via a pin 4.

According to the twelfth aspect of the present invention, two sets of components are arranged face to face each other, each set comprising: the paired outer casings 8; the insertion bodies 9 inserted one in each of the outer casings 8; a plurality of the vertically-arranged rung members 6; the locking mechanism 7 situated near the lowermost rung member 6; and the operating means 93 having the operating rod 96 situated near the uppermost rung member 6, and, the two sets are foldably coupled to each other by foldably connecting their outer casings 8 to corresponding lengthwise ends of a top plate 112 via a pin 116.

According to the fourteenth aspect of the present invention, the outer casing 8 is made smaller in length than the top plate 112, and, the insertion body 9 can be secured to the outer casing 8 via the locking mechanism 7 in a manner such that a dimension of the insertion body 9 in a state of being telescopically extended out of the outer casing 8 corresponding to a distance from the pin 116 to a front end of the insertion body 9 is substantially equal to a dimension of the top plate 112 corresponding to a distance from the pin 116 at one end of the top plate 112 to the other end thereof.

Advantageous Effects of Invention

According to the present invention, each of simultaneous unlocking operation of the paired locking mechanisms and unlocking operation of one of the locking mechanisms alone can be effected in a selective manner by operating a single operating rod.

That is, by manipulating the midportion of the operating rod in the unlocking direction, the operating rod as a whole can be moved in the unlocking direction for concurrent movements of the paired operating members in the unlocking direction, thus unlocking the paired locking mechanisms for concurrent telescoping movements of the paired telescoping bodies. This makes possible easy telescoping adjustment of the paired telescoping bodies.

Moreover, by manipulating one end of the operating rod in the unlocking direction, the one end of the operating rod is moved in the unlocking direction, and the operating rod is inclined with consequent movement of one of the operating members alone in the unlocking direction. At this time, the other one of the operating members will no longer be moved in the unlocking direction, with the consequence that one of the locking mechanisms is unlocked, whereas the other is kept locked. Thus, only one of the telescoping bodies is allowed to telescope, wherefore telescoping adjustment of one of the telescoping bodies alone can be achieved quickly with ease.

The unlocking operation can be effected not only by operating the operating rod but also by operating the locking member supported on the pivot shaft with the handle.

Moreover, when the linkage tool is moved to the locking position, the linkage means brings the locking member into engagement with the insertion body, and, at the same time, the disengagement preventive means inhibits the locking member from rocking motion for disengagement. That is, the disengagement preventive means prevents the locking member from being accidentally removed from engagement with the insertion body.

Moreover, when the linkage tool goes out of the locking position for movement to the unlocking position, the disengagement preventive means permits the locking member to rock for disengagement. When the linkage tool is moved to the unlocking position, the linkage means disengages the locking member from the insertion body. That is, with the movement of the linkage tool from the locking position to the unlocking position and vice versa, the locking member can be readily operated to change from an insertion body-engaged state to an insertion body-disengaged state and vice versa, thus facilitating telescoping adjustment operation.

Moreover, the arrangement of the operating member along the outer face of the outer casing precludes the possibility that the locking mechanism or the operating member will constitute an obstruction to usage of the telescopic device.

The locking mechanism is situated near the lowermost rung member, and the operating rod is situated near the uppermost rung member. This makes it possible to unlock the locking mechanism while holding the telescopic device in vertical position.

DESCRIPTION OF EMBODIMENTS

Hereinafter, embodiments of the present invention will be described with reference to drawings.

Figure 1:
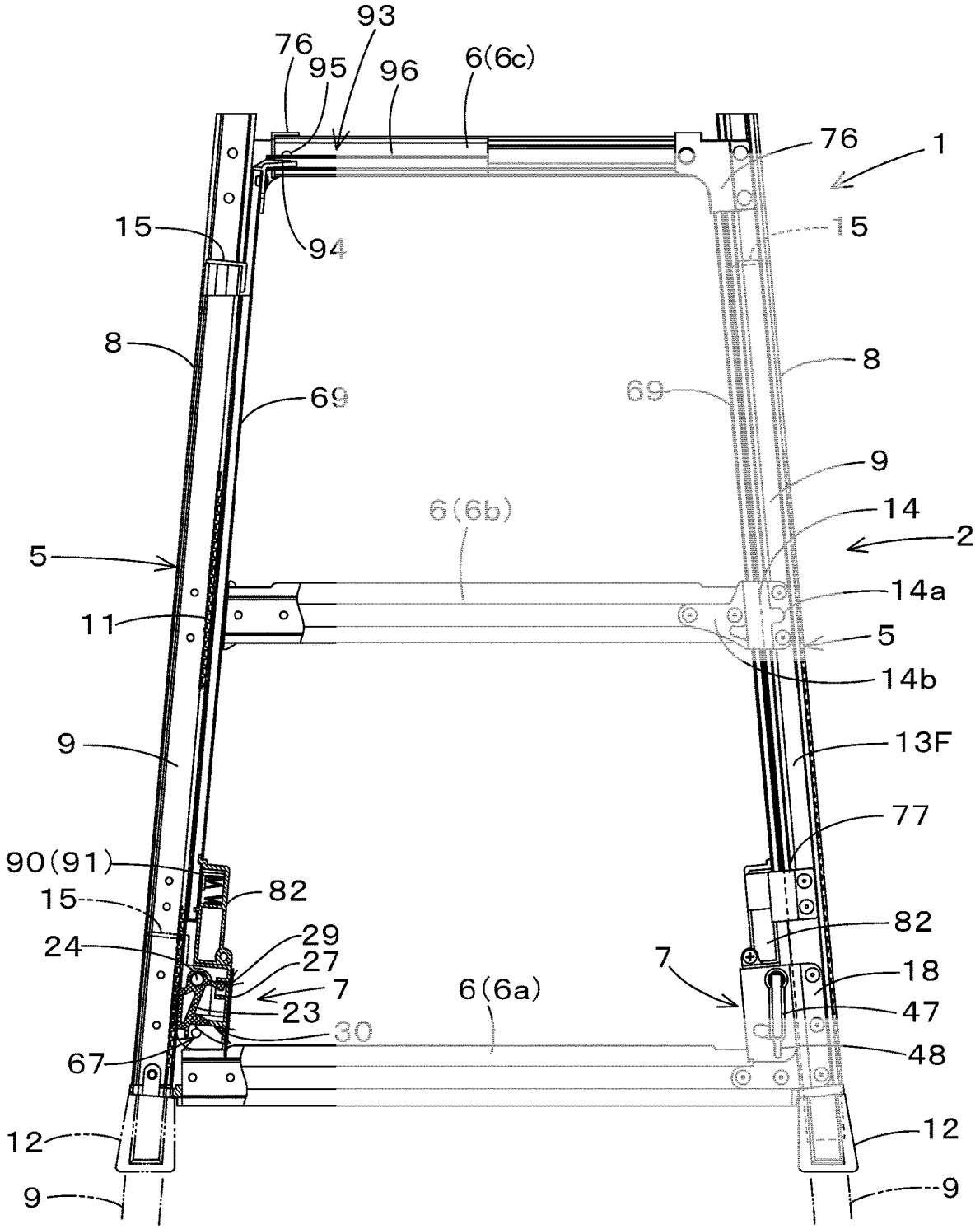
FIG. 1 is a front view, partly in section, of the first embodiment, illustrating a telescopic device pursuant to the present invention embodied in a stepladder.
Figure 12:
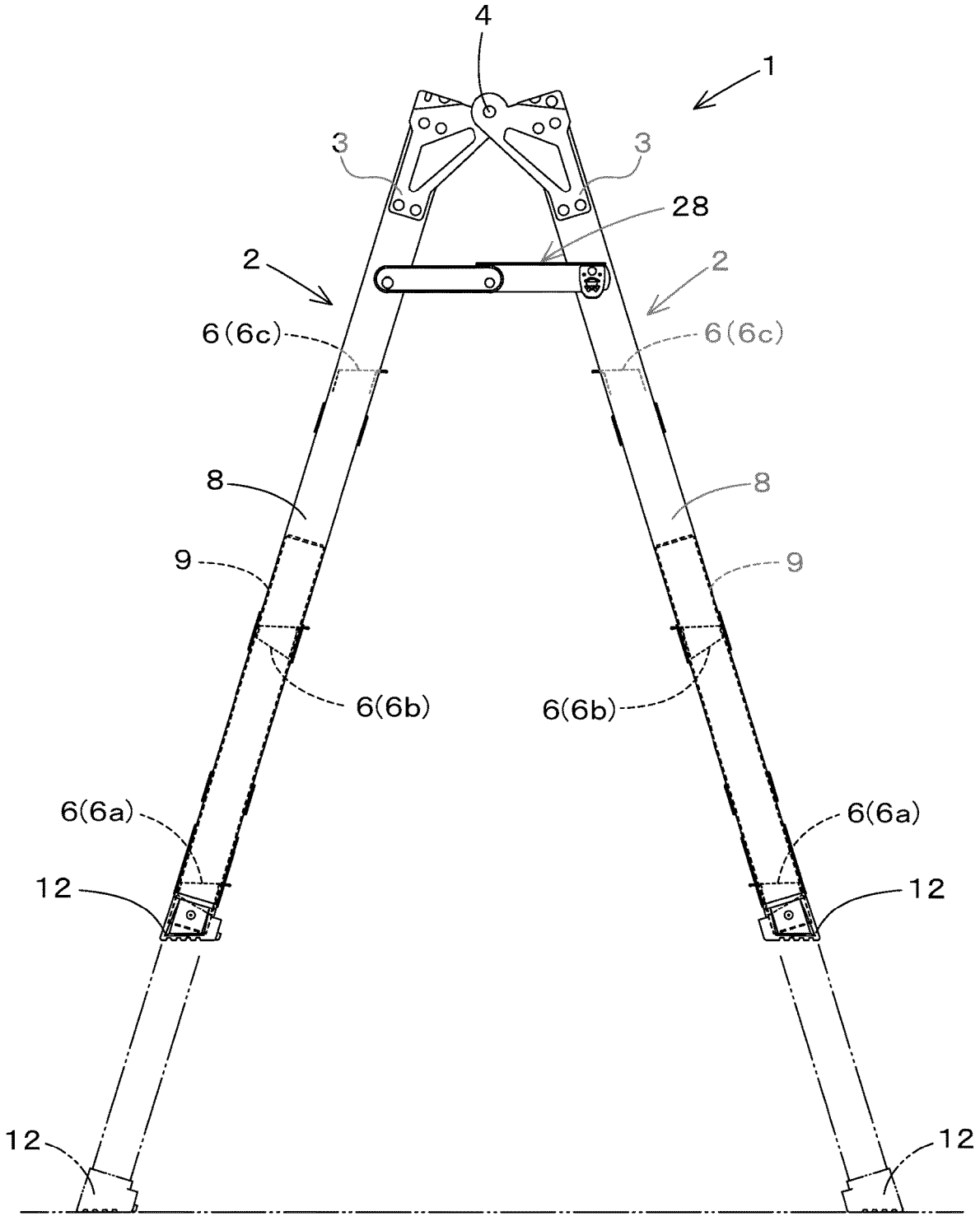
FIG. 12 is a general side view of a stepladder.

FIGS. 1 to 12 are drawings of the first embodiment, illustrating a telescopic device pursuant to the present invention embodied in a stepladder. A stepladder as shown in FIGS. 1 and 12 is mainly composed of a pair of opposed ladders 2 pivotally interconnected via brackets 3 at their tops by a pin 4. The stepladder 1 can be put into service by setting the paired ladders 2 on the ground surface, as well as by releasing the lock on a retention tool 28 locking the paired ladders 2 to prevent movement of the two ladders 2 apart to turn one of the ladders 2 about the pin 4.

The ladder 2 comprises: a pair of telescoping supports 5 (telescoping bodies) spaced apart in a right-left, or horizontal direction; a plurality of rung members (crosspiece members) 6 each providing a connection between the right-hand and left-hand supports 5; and a locking mechanism 7 situated between the support 5 and the rung member 6.

In the following description, that side of the stepladder 1 where the rung member 6 is stepped on is defined as a front side, and, the opposite ends of the rung member 6 in the horizontal direction are coupled to the vertically-elongated right-hand and left-hand supports 5, respectively, and the paired ladders 2 are coupled to each other in a front-rear direction via the pin 4.

Each of the right-hand and left-hand supports 5 comprises: a support main body 8 (outer casing) constructed of a channel member; and a prismatic leg column 9 (insertion body) inserted within the support main body 8. The support 5 is designed to telescope freely upon sliding motion of the leg column 9 in an axial direction (vertical direction), and, the leg column 9 is locked, while being restrained against further axial movement, in a predetermined position corresponding to the telescoped position of the support 5 by the locking mechanism 7.

In FIGS. 1 to 10, each support main body 8 is made of a metal such as aluminum having a substantially U-shaped sectional profile. The opposing sides of the support main bodies 8 are each formed with a longitudinally-extending opening slot 10.

Like the support main body 8, the leg column 9 is made of a metal such as aluminum, and has a plurality of retention portions 11 (rack) formed on its side wall in corresponding relation to the opening slot 10 at each of the opposing sides of the support main bodies 8. The leg column 9 has its lower end attached to a ground-mounted member 12 which permits stable placement of the ladder 2 on the ground surface. In the leg column 9, its upper part serving as an insertion base part is provided with a retainer member 15 formed so as to protrude outwardly from the opening slot 10. The retainer member 15 abuts on a support frame 18 of the locking mechanism 7 as will hereafter be described to prevent the leg column 9 from accidentally becoming detached from the support main body 8.

Figure 6:
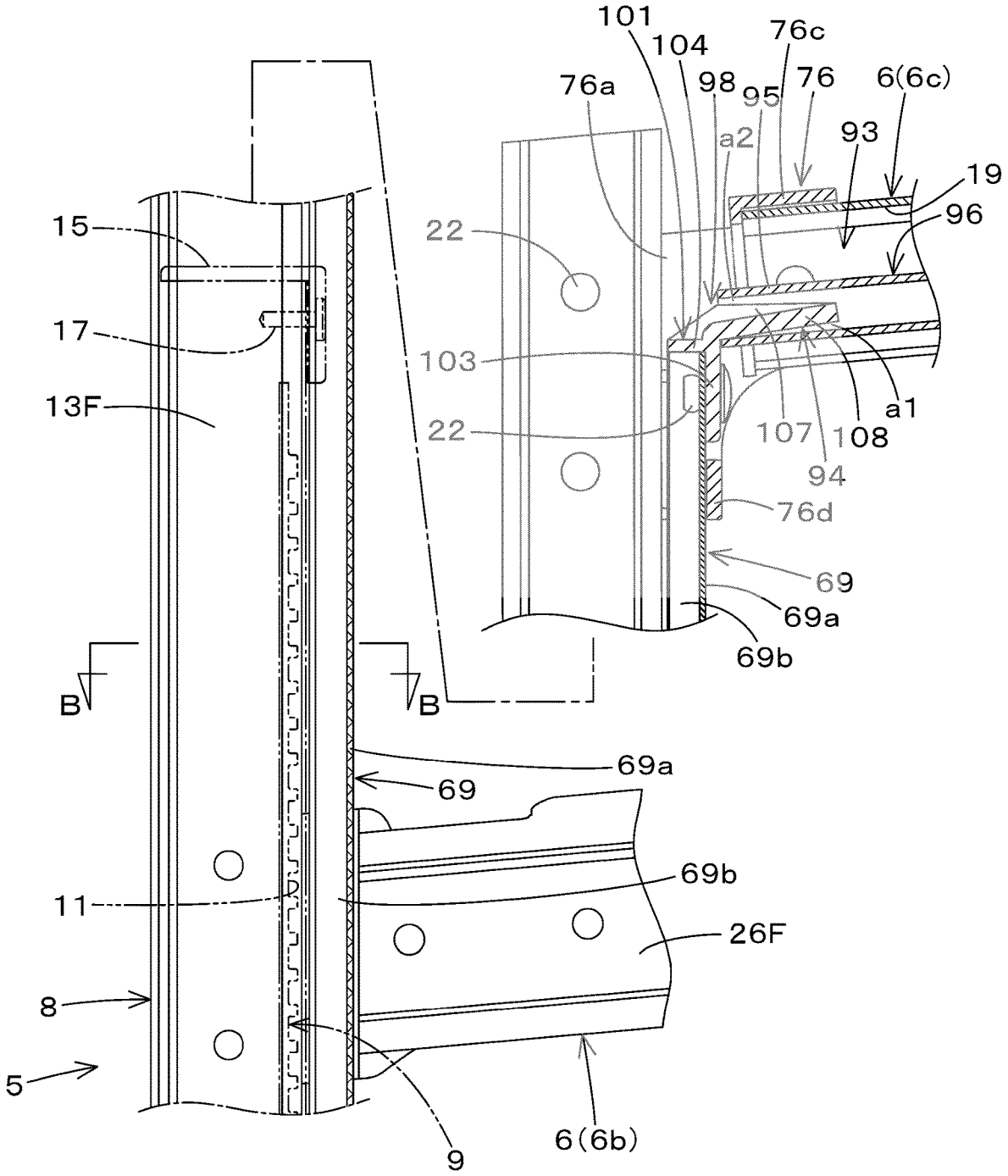
FIG. 6 is a front sectional view of the upper part of the support.
Figure 7:
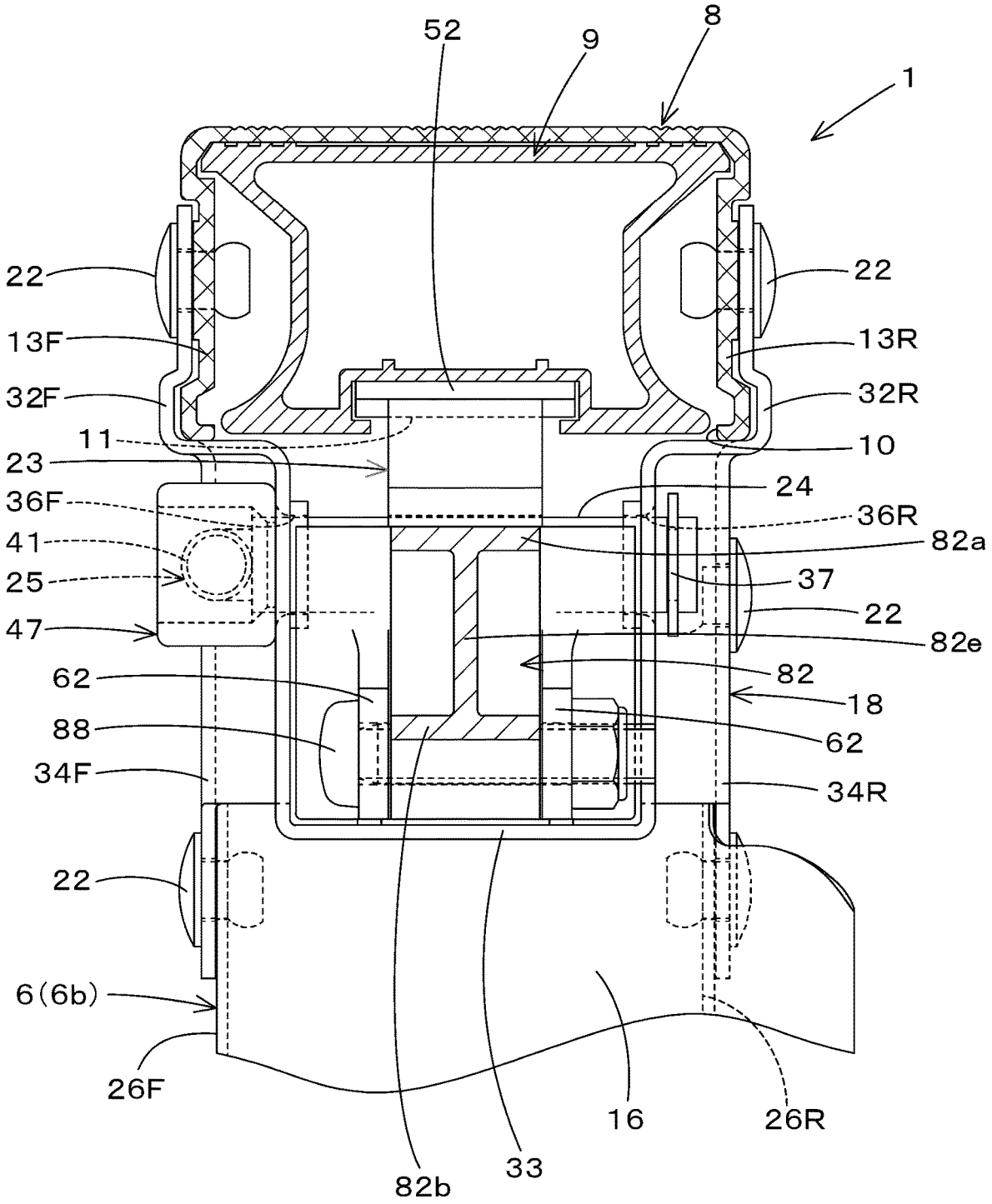
FIG. 7 is a sectional view of the support taken along the line A-A shown in FIG. 4.

As shown in FIG. 6, the retainer member 15 is detachably secured to the leg column 9 by a securing tool 17 such as a bolt.

From among the rung members 6 of the ladder 2, the lowermost rung member 6 (6*a*) and the intermediate rung member 6 (6*b*) are each constructed of a tubular member shaped so that its vertical width becomes larger gradually from the front to the rear to define a substantially trapezoidal sectional profile. The uppermost rung member 6 (6*c*) is constructed of an open-bottomed member with a recess 19 having a substantially U-shaped sectional profile. Such a rung member 6 is configured so that its topside step 16 stays horizontal when the stepladder 1 is unfolded and set in upstanding condition, and, the step 16 is longitudinally indented for slippage prevention purposes.

The intermediate rung member 6 (6*b*) of the ladder 2 is held securely across the right-hand and left-hand support main bodies 8 via platy brackets 14 attached to front and rear side walls 13F and 13R of the support main body 8.

Figure 8:
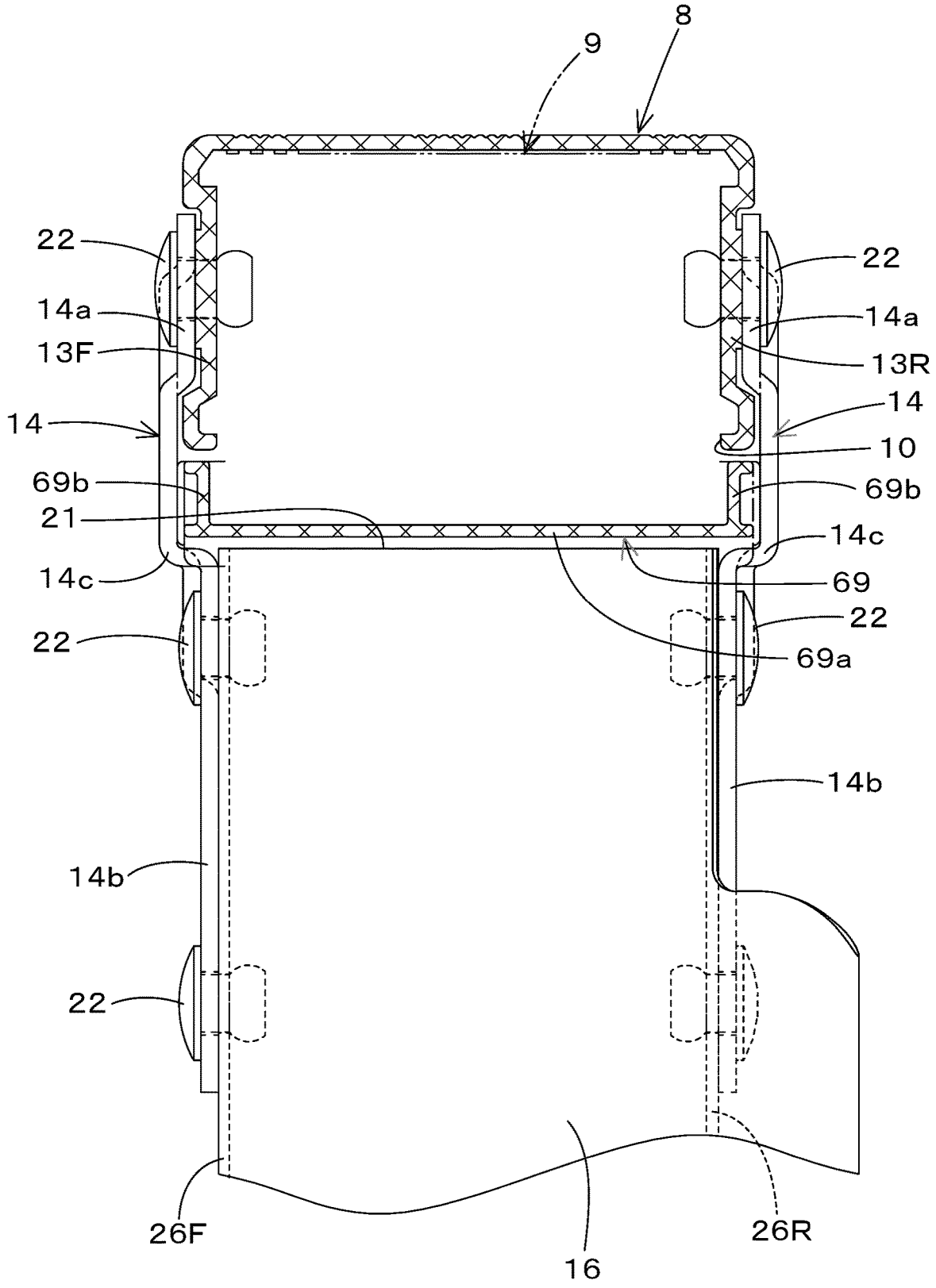
FIG. 8 is a sectional view of the support taken along the line B-B shown in FIG. 6.
Figure 9:
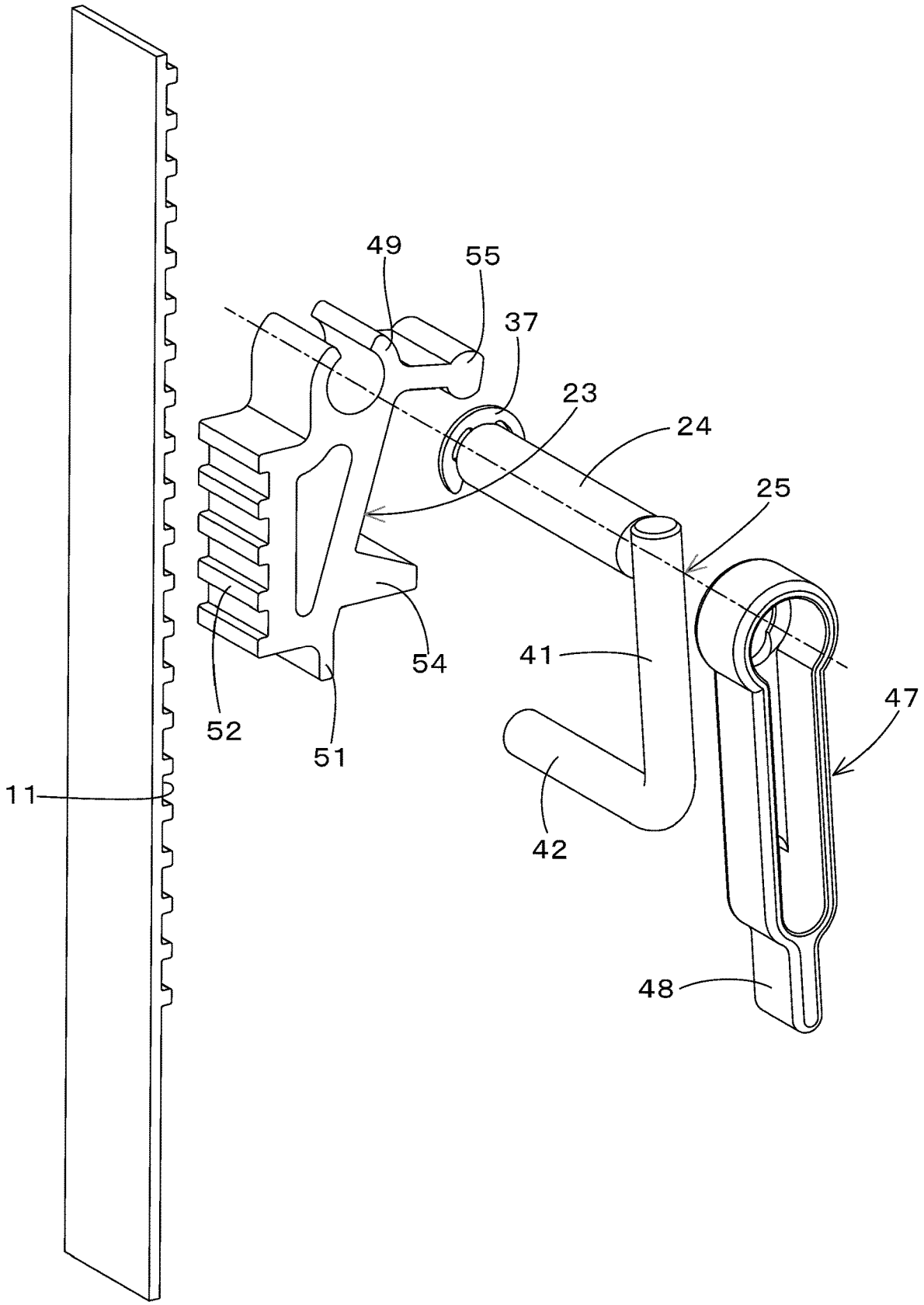
FIG. 9 is an exploded perspective view of a locking member, a handle, and so forth.

The platy brackets 14 are arranged in pairs of the front-side and rear-side brackets in corresponding relation to the outer edges of the rung member 6. Each bracket 14 comprises: a support-side fixed portion 14*a*; a rung-side fixed portion 14*b*; and a shoulder portion 14*c* interposed between the fixed portions. The support-side fixed portion 14*a* is secured to the support main body 8 via a fixing tool 22 such as a rivet, and the rung-side fixed portion 14*b* is secured to the outer edge of the rung member 6 via the fixing tool 22 such as a rivet. As shown in FIG. 8, an insertion space 21 for an operating member 69 as will hereafter be described is left between the outer side of the support main body 8 and an end of the rung member 6.

The locking mechanism 7 is disposed between each of the supports 5 and the lowermost rung member 6*a* of the ladder 2. That is, one locking mechanism 7 is provided for each support 5, and the locking mechanism 7 is mounted at each of the opposing sides of the right-hand and left-hand support main bodies 8.

The locking mechanism 7 comprises: a support frame 18 secured to the support main body 8; a locking member 23 pivotally mounted for rocking motion in the horizontal direction (the direction indicated by arrow a in FIGS. 4 and 5) relative to the support frame 18, the locking member 23 being engageable with the retention portion 11 of the leg column 9; a pivot shaft 24 for rockably supporting the locking member 23; and a handle 25 supported on the pivot shaft 24 to rock the locking member 23 for disengagement from the leg column 9 (operate the locking member 23 to go out of engagement with the leg column 9).

The locking member 23 is free to rock horizontally about the pivot shaft 24 supported on the support frame 18 as will hereafter be described. The locking member 23 is rocked in movable relation toward and away from the leg column 9 for engagement with and disengagement from the retention portion 11.

Figure 4:
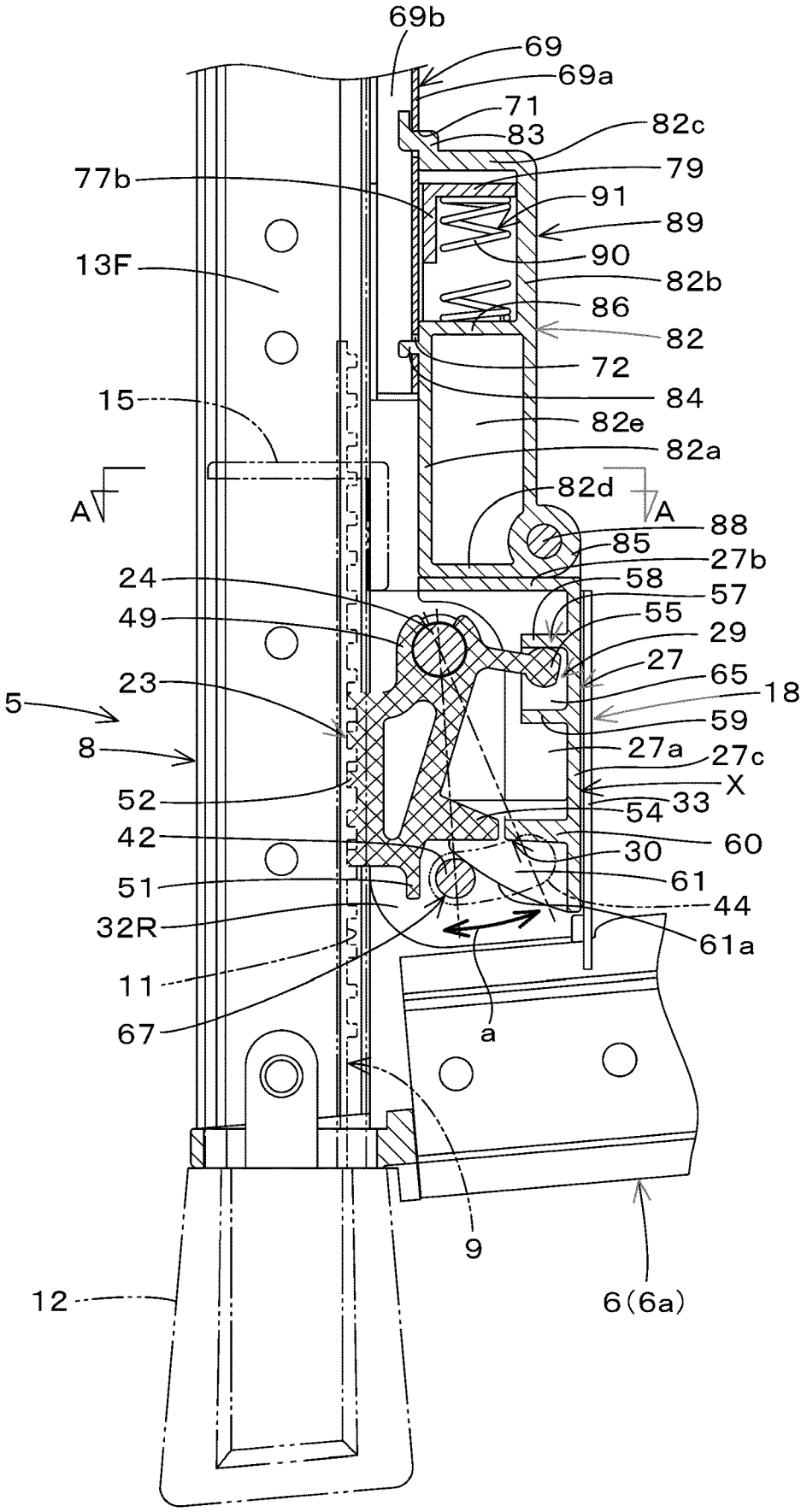
FIG. 4 is a front sectional view of the lower part of the support.
Figure 5:
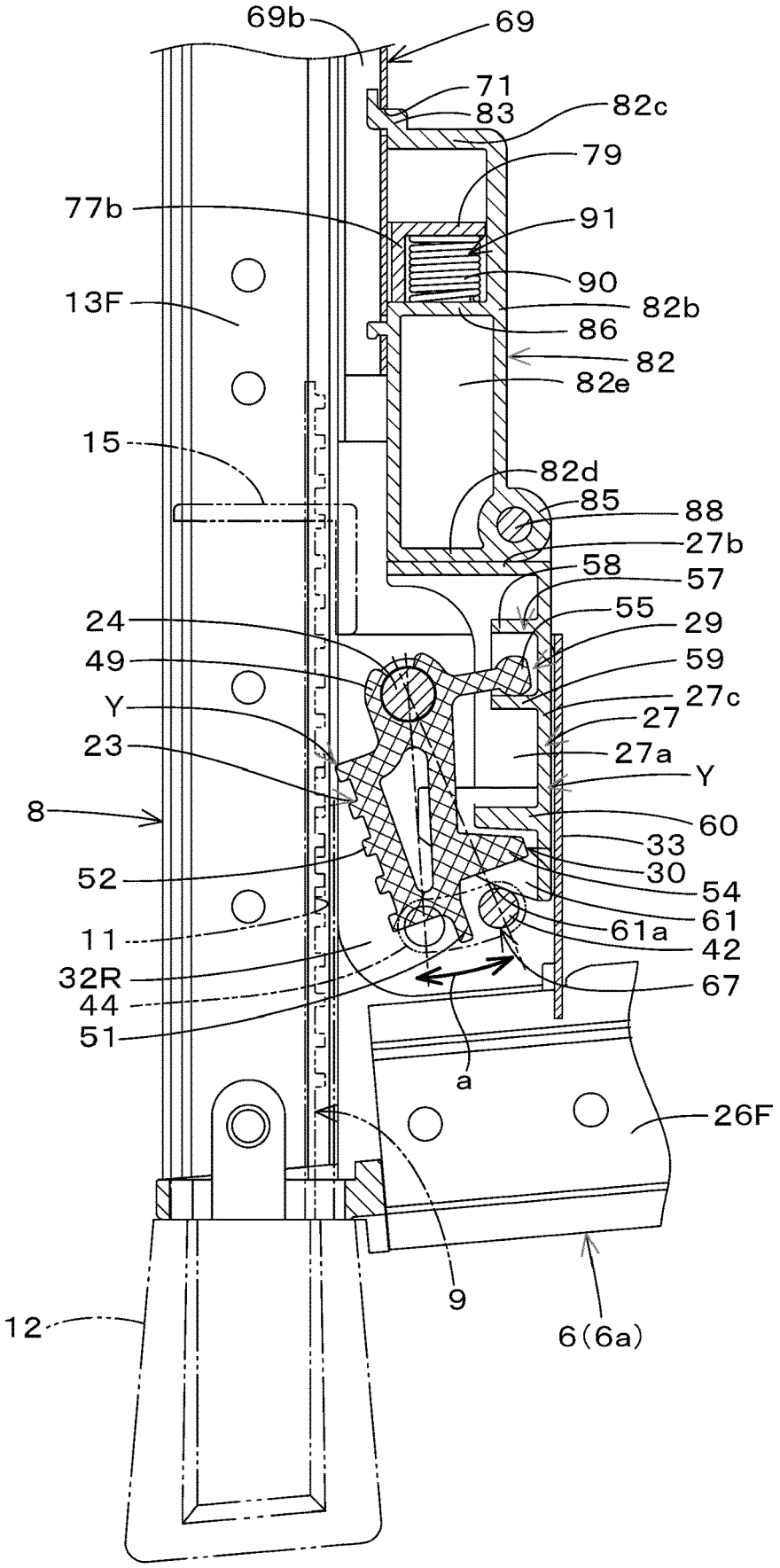
FIG. 5 is a front sectional view of the lower part of the support in unlocked position.

Moreover, in the locking mechanism 7, the support frame 18 is provided with a linkage tool 27 supported for movement between a locking position X and an unlocking position Y as shown in FIGS. 4 and 5, and, linkage means 29 and disengagement preventive means 30 are disposed between the locking member 23 and the linkage tool 27. The linkage means 29 brings the locking member 23 into engagement with the leg column 9 when the linkage tool 27 is moved to the locking position X, and releases the engagement of the locking member 23 with the leg column 9 when the linkage tool 27 is moved to the unlocking position Y, and, the disengagement preventive means 30 inhibits the locking member 23 from rocking motion for disengagement when the linkage tool 27 is moved to the locking position X, and permits the locking member 23 to rock for disengagement when the linkage tool 27 goes out of the locking position X.

The support frame 18 is formed of a single platy material of metal such as aluminum bent in a box-like configuration, and is made attachable to the support main body 8 and the rung member 6. The support frame 18 opens toward the leg column 9 (toward the support 5), and comprises: paired front and rear sidewall portions 32F and 32R attached to the front and rear side walls 13F and 13R, respectively, of the support main body 8, each extending further over corresponding one of the opposing sides of the support main bodies 8; a back wall portion 33 located between the front and rear sidewall portions 32F and 32R in face-to-face relation to the engagement portion 11 of the leg column 9; and paired rung-mounted portions 34F and 34R attached to the rung member 6, each extending downwardly from the lower part of corresponding one of the front and rear sidewall portions 32F and 32R.

The outward part of the front/rear sidewall portion 32F, 32R of the support frame 18 is configured for insertion of the front/rear side wall 13F, 13R of the support main body 8. After the support frame 18 is set so that the front/rear side wall 13F, 13R of the support main body 8 is held by the outward part of the front/rear sidewall portion 32F, 32R, the fixing tool 22 such as a rivet is driven to attach the support frame 18 to the support main body 8.

The rung-mounted portions 34F and 34R of the support frame 18 are configured for insertion of the ends of front and rear side walls 26F and 26R, respectively, of the rung member 6. After the support frame 18 is set so that the front and rear side walls 26F and 26R of the rung member 6 are held at their ends by the rung-mounted portions 34F and 34R, the fixing tool 22 such as a rivet is driven to attach the support frame 18 to the rung member 6.

Hence, the support frame 18 functions also as a bracket for coupling the rung member 6 to the support 5. This helps reduce the number of brackets required to attach the rung member 6 to the support 5.

When attaching the support frame 18 to the rung member 6, the topside step 16 of the rung member 6 goes into the support frame 18. The back wall portion 33 of the support frame 18 is shaped in a vertical plate aligned with the front-rear direction.

The pivot shaft 24 is cylindrically shaped, extends all the way through between the front and rear sidewall portions 32F and 32R of the support frame 18, and is supported so as to be rotatable in the same direction as the direction of rocking motion of the locking member 23.

The tip of the pivot shaft 24 is provided with a retaining ring 37 which is larger in diameter than a pivot shaft through hole 36R (one of pivot shaft through holes 36F and 36R) of the rear sidewall portion 32R. When pulling the pivot shaft 24 forward, the retaining ring 37 abuts against the rear sidewall portion 32R so as to serve as a stopper for preventing the pivot shaft 24 from coming off through the pivot shaft through hole 36R.

As shown in FIGS. 3 to 5 and FIG. 9, the handle 25 comprises a grip 41 and an operation portion 42 extended from the grip 41 toward the linkage tool 27. The grip 41 is welded or otherwise fixed to one end (forward end) of the pivot shaft 24, is placed along the outer face of the front sidewall portion 32F, and provides a connection between the pivot shaft 24 and the front part of the operation portion 42. The operation portion 42 is cylindrically shaped, is spaced away from the pivot shaft 24 in a radial direction, and protrudes rearwardly. The pivot shaft 24, the grip 41, and the operation portion 42 are arranged in substantially the shape of the letter "U" as seen in side view.

The operation portion 42 of the handle 25 is inserted into an operation portion through hole 44 formed in the lower part of the front sidewall portion 32F of the support frame 18. The operation portion through hole 44 has the shape of an arc whose center coincides with the axis of the pivot shaft 24 (the center of the pivot shaft through hole 36F, 36R).

The grip 41 of the handle 25 connects the pivot shaft 24 and the operation portion 42 in unitary relation. A synthetic resin-made handle cover 47 is exteriorly fitted to the grip 41, the front part of the pivot shaft 24, and the front part of the operation portion 42 so as to cover the periphery at the grip 41, the front part of the pivot shaft 24, and the front part of the operation portion 42. The handle cover 47 has formed at its bottom a downwardly-protruding knob 48 having a small horizontal width.

The locking member 23, which is situated between the front and rear sidewall portions 32F and 32R of the support frame 18, comprises: a pivot shaft-mounted portion 49 which is attached to substantially the midportion of the pivot shaft 24 in the front-rear direction; a rocking projection 51 located outwardly of the operation portion 42, and a fit portion 52 which is fitted to the retention portion 11 of the leg column 9.

The pivot shaft-mounted portion 49 of the locking member 23 is exteriorly fitted to the pivot shaft 24 for rotation, and the locking member 23 is thus supported so as to be rockable about the pivot shaft 24 in the horizontal direction (the direction of arrow a). The lower part (free end) of the locking member 23 is provided with a pressing portion 54 protruding toward the linkage tool 27, and, the pivot shaft-mounted portion 49 has an inwardly-protruding operation piece 55.

Figure 10:
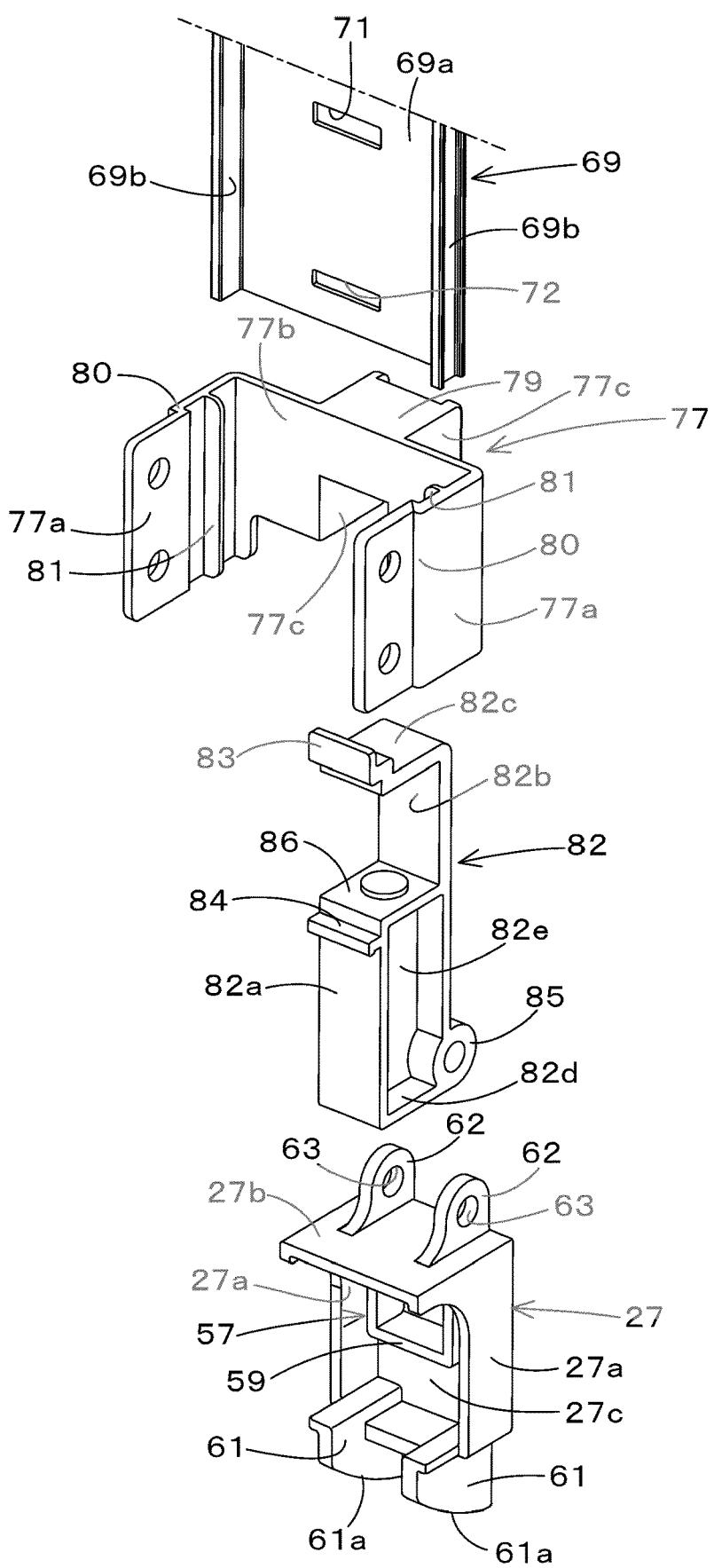
FIG. 10 is an exploded perspective view of a lower guide member, a coupler, a linkage tool, and so forth.
Figure 11:
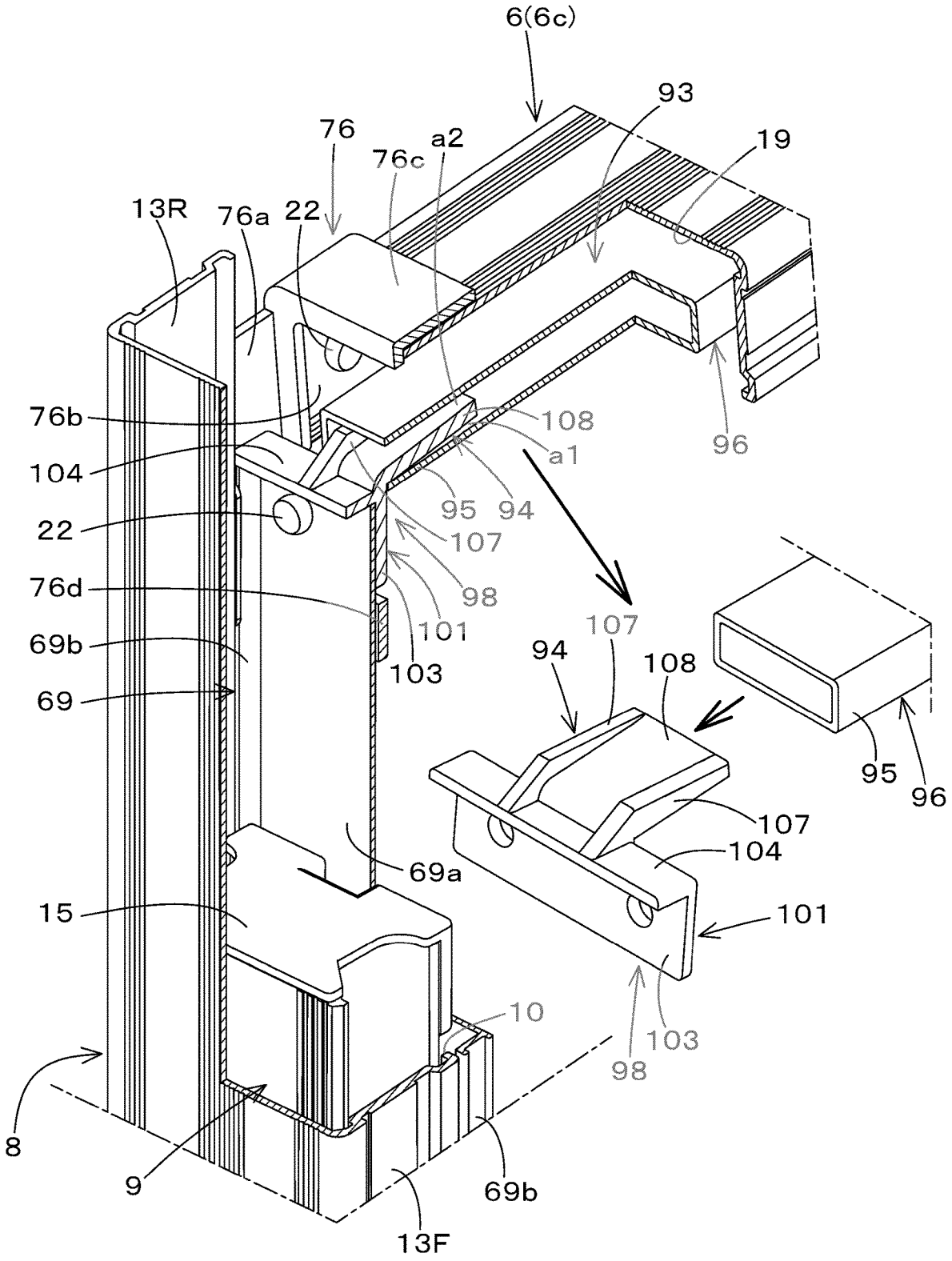
FIG. 11 is a perspective view, partly in section, of the upper part of the support and operating means.

As shown in FIGS. 4, 5, and 10, the linkage tool 27 is shaped in an outwardly-opening box having a pair of front and rear side walls 27*a*, an upper wall 27*b* providing a connection between the upper parts of the front and rear side walls 27*a*, and a back wall 27*c* providing a connection between the horizontally inward ends of the front and rear side walls 27*a*. The linkage tool 27 is disposed in upwardly-protruding condition inwardly of the locking member 23 in the horizontal direction within the support frame 18, and is held along the inner face of the back wall portion 33 of the support frame 18 for vertical sliding motion (vertical movement). Hence, the linkage tool 27 of each of the right-hand and left-hand support frames 18 is held along corresponding one of the opposing sides of the right-hand and left-hand support main bodies 8 for longitudinal movement.

In the linkage tool 27, the upper part of the back wall 27*c* is provided with an outwardly-protruding prismatic body 57 whose upper part and lower part serve as a first press-moving piece 58 and a second press-moving piece 59, respectively. The first press-moving piece 58 and the second press-moving piece 59 are spaced apart in the vertical direction, with the tip of the operation piece 55 lying in between. Disposed below the prismatic body 57 of the back wall 27*c* is an outwardly-protruding restraint portion 60, and, paired front and rear cam walls 61 each having an arcuate cam face 61*a* are disposed one on each side of the restraint portion 60 in the front-rear direction.

The upper wall 27*b* of the linkage tool 27 is provided with a pair of upwardly-protruding front and rear coupling pieces 62. Each coupling piece 62 is formed with an attachment hole 63.

Thus, the linkage means 29 comprises: the operation piece 55 formed in protrusion form in the locking member 23; and the first press-moving piece 58 and the second press-moving piece 59 each formed in protrusion form in the linkage tool 27. The first press-moving piece 58 and the second press-moving piece 59 are arranged so as to have sandwiched therebetween the operation piece 55 in the direction of movement of the linkage tool 27. The linkage means 29 is designed so that, when the linkage tool 27 is moved to the locking position X, the first press-moving piece 58 presses the operation piece 55 into movement to rock the locking member 23 in an engaging direction, whereas, when the linkage tool 27 is moved to the unlocking position Y, the second press-moving piece 59 presses the operation piece 55 into movement to rock the locking member 23 in a disengaging direction.

In this embodiment, when the linkage tool 27 is moved from the unlocking position Y to the locking position X, at first, the restraint portion 60 presses the pressing portion 54 into downward movement to rock the locking member 23 in the engaging direction, whereafter the first press-moving piece 58 presses the operation piece 55 into downward movement. When the linkage tool 27 reaches the locking position X, the rocking motion of the locking member 23 in the engaging direction is completed.

Moreover, the earlier described disengagement preventive means 30 comprises: the pressing portion 54 disposed at the rocking end of the locking member 23 so as to protrude toward the linkage tool 27; and the restraint portion 60 disposed in the linkage tool 27 so as to protrude toward the pressing portion 54. The disengagement preventive means 30 is designed so that, when the linkage tool 27 is moved to the locking position X, the pressing portion 54 and the restraint portion 60 confront each other to restrain the locking member 23 against rocking motion for disengagement, whereas, when the linkage tool 27 goes out of the locking position X, the restraint portion 60 is displaced from the position of confrontation with the pressing portion 54 to permit the locking member 23 to rock for disengagement.

Moreover, in order for the locking member 23 to start to rock for disengagement after the removal of the restraint portion 60 away from the pressing portion 54 when the linkage tool 27 is moved from the locking position X to the unlocking position Y, as shown in FIG. 4, an idle clearance 65 is left between the second press-moving piece 59 and the operation piece 55.

Disposed between the grip 41 and the linkage tool 27 is linkage tool press-moving means 67 for pressing the linkage tool 27 into movement to the unlocking position Y against the urgence exerted by an urging member 91 as will hereafter be described by turning the handle 25 about the pivot shaft 24 horizontally inwardly along the direction of arrow a. The linkage tool press-moving means 67 is composed of the outer periphery of the operation portion 42 and the cam faces 61*a* of the front and rear cam walls 61 of the linkage tool 27.

As shown in FIGS. 2, 3, 6, 8, and 10, the operating member 69 for operating the locking member 23 is disposed in vertically-standing condition on each of the opposing sides (outer faces) of the right-hand and left-hand support main bodies 8 so as to cover the opening slot 10. The operating member 69 is elongated in the vertical direction, is held along corresponding one of the opposing sides (outer faces) of the support main bodies 8 for longitudinal movement, and is inserted and held in the earlier described insertion space 21 for vertical movement. The linkage tool 27 is coupled, via a coupler 82 as will hereafter be described, to the lower end (one end) of the operating member 69, thus permitting linkage of the operating member 69 to the locking member 23. The upper part of the operating member 69 extends up to a location near the bottom of the uppermost rung member 6*c*.

The operating member 69 comprises: a vertically-elongated platy operating wall portion 69*a*; and paired front and rear sidewall portions 69*b* extending outwardly from the opposite ends, respectively, of the operating wall portion 69*a* in the front-rear direction. The lower part of the operating wall portion 69*a* is formed with an upper retaining hole 71 and a lower retaining hole 72 that are spaced apart in the vertical direction. Each retaining hole 71, 72 has the form of a rectangular hole elongated in the front-rear direction.

The support main body 8 is provided with an upper guide member 76 and a lower guide member 77 for guiding the described operating member 69 in movement.

As shown in FIGS. 2, 3, 6, and 11, the upper guide member 76 comprises: a pair of front and rear side walls 76*a*; paired front and rear attachment walls 76*b* formed in the upper parts of, respectively, the front and rear side walls 76*a* so as to extend horizontally inwardly; a horizontal plate-shaped upper coupling wall 76*c* coupled to the upper parts of the front and rear attachment walls 76*b*; and a vertical plate-shaped lower coupling wall 76*d* coupled to the lower parts of the front and rear side walls 76*a*. By driving the fixing tool 22 such as a rivet, the front/rear side wall 76*a* is fixedly attached to the front/rear side wall 13F, 13R of the support main body 8. Each end of the uppermost rung member 6*c* in the horizontal direction is fitted in the interior defined by the upper coupling wall 76*c* and the front and rear attachment walls 76*b*, and secured to the front and rear attachment walls 76*b* by the fixing tool 22 such as a rivet.

Figure 2:
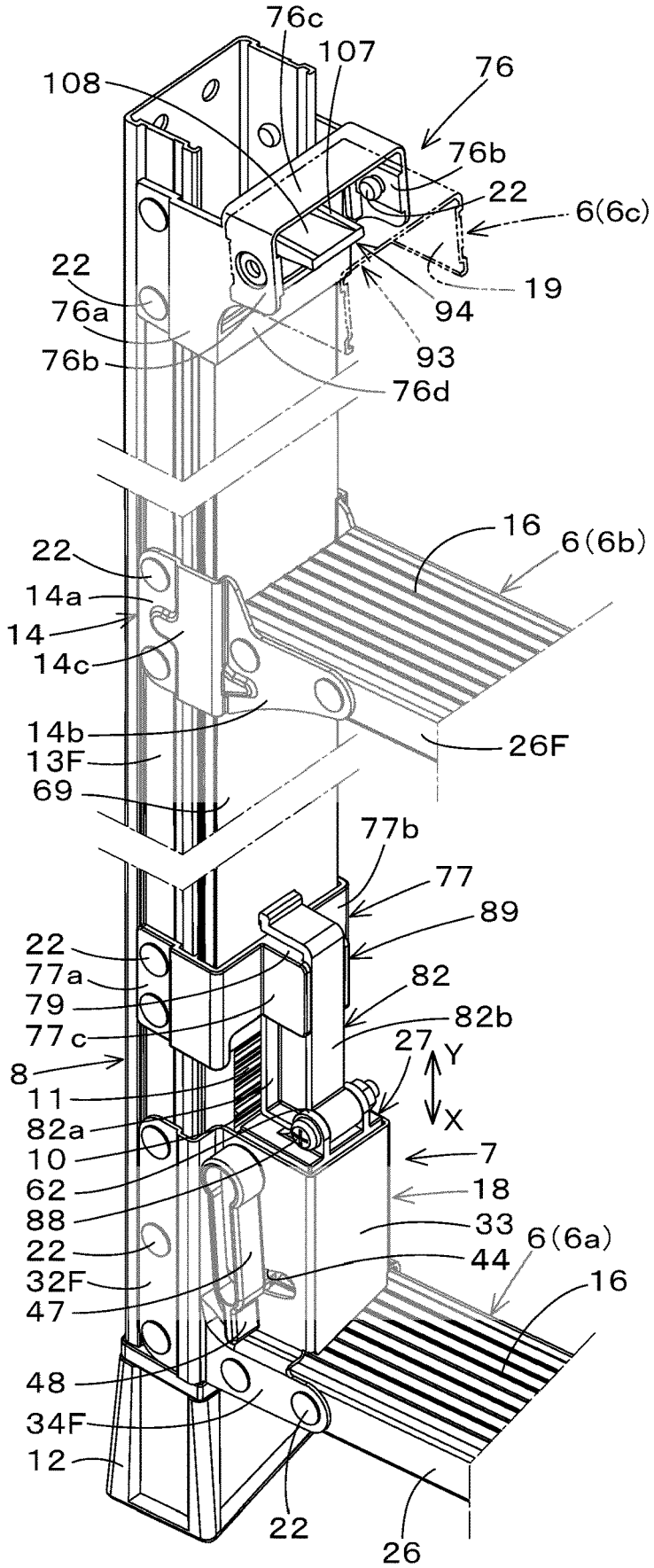
FIG. 2 is a perspective view of a support.
Figure 3:
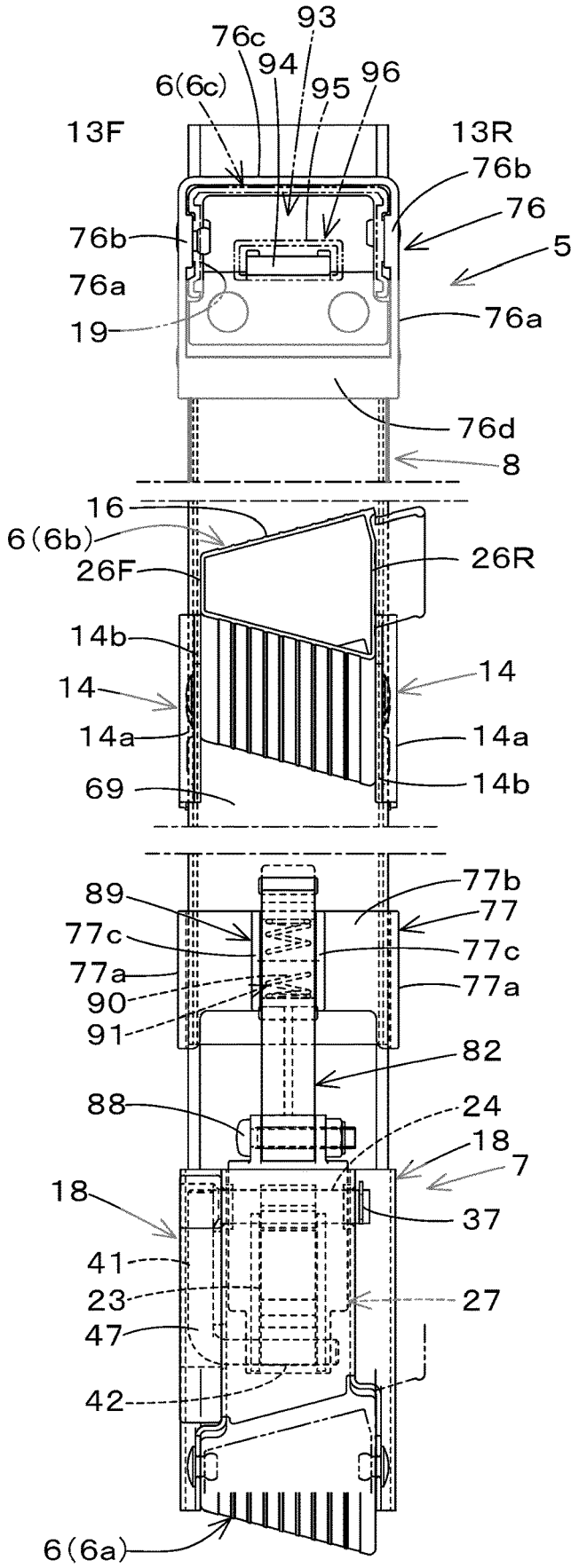
FIG. 3 is a side view of the support as seen from the interior.

As shown in FIGS. 2, 3, and 10, the lower guide member 77 comprises: a pair of front and rear side walls 77*a*; a back wall 77*b* providing a connection between the inward ends of the front and rear side walls 77*a*; a pair of front and rear housing side walls 77*c* protruding inwardly from the back wall 77*b*; and an upper spring bearing wall 79 protruding inwardly from the upper part of the back wall 77*b* so as to block the space between the tops of the housing side walls 77*c*.

The front/rear side wall 77*a* has a shoulder portion 80 intermediate the horizontal length thereof. An engagement piece 81 is disposed inwardly of the shoulder portion 80 so as to protrude inwardly in the front-rear direction. By driving the fixing tool 22 such as a rivet, the outward part of the front/rear side wall 77*a* is fixedly attached to the front/rear side wall 13F, 13R of the support main body 8. The operating member 69 is held, at its ends in the front-rear direction, between the shoulder portion 80 and the engagement piece 81 for vertical movement.

As shown in FIGS. 2 to 5 and FIG. 10, the coupler 82 is situated between the described linkage tool 27 and one end of the operating member 69. The coupler 82 has a front wall 82*a* and a back wall 82*b* at its ends in the horizontal direction, respectively. The back wall 82*b* extends upwardly above the level of the front wall 82*a*, and an upper wall 82*c* is formed so as to protrude inwardly from the top of the back wall 82*b*. The upper wall 82*c* has an upper engagement piece 83 bent upwardly and outwardly from the outer side thereof in a stepped configuration. There are also provided: a bottom wall 82*d* providing a connection between the bottoms of the back wall 82*b* and the front wall 82*a*; a cylindrical coupling tube 85 situated between the back wall 82*b* and the bottom wall 82*d*; a lower spring bearing wall 86 providing a connection between the top of the front wall 82*a* and the intermediate part of the back wall 82*b*; a coupling wall 82*e* providing a connection between the midportion of the lower spring bearing wall 86 in the front-rear direction and the front wall 82*a*, the back wall 82*b*, and the bottom wall 82*d*; and a lower engagement piece 84 protruding in hook form outwardly from the upper part of the front wall 82*a*.

The coupler 82 is detachably fastened in downwardly-protruding fashion to the lower part of the operating member 69 by following a step of disengageably fitting the upper engagement piece 83 in the upper retaining hole 71 of the operating member 69 and a step of disengageably fitting the lower engagement piece 84 in the lower retaining hole 72.

The coupler 82 is emplaced at its bottom wall 82*d* on the upper wall 27*b* of the linkage tool 27, and then fastened by a fastening tool 88 such as nut-and-bolt fastening means inserted through the front and rear coupling pieces 62 and the coupling tube 85. In this way, the coupler 82 can be detachably coupled to the linkage tool 27.

Thus, the upper half of the back wall 82*b* of the coupler 82, the lower spring bearing wall 86, the front and rear housing side walls 77*c* of the lower guide member 77, and the upper spring bearing wall 79 constitute a spring housing case 89.

A coiled spring 90 is accommodated in vertically-standing condition inside the spring housing case 89. The coiled spring 90 has its upper end received by the upper spring bearing wall 79, and its lower end received by the lower spring bearing wall 86. The coiled spring 90 urges the coupler 82, the linkage tool 27, and their included components downwardly relative to the lower guide member 77. Thus, the linkage tool 27 is urged toward the locking position X by the urging member 91 constructed of the coiled spring 90.

Moreover, by following a step of detaching the coupler 82 from the operating member 69 by disengaging the upper engagement piece 83 and the lower engagement piece 84 from the upper retaining hole 71 and the lower retaining hole 72, respectively, and a step of detaching the coupler 82 from the linkage tool 27 by removing the fastening tool 88, it is possible to withdraw the coupler 82 from the position between the operating member 69 and the linkage tool 27, and thereby leave the opening slot 10 open.

Also by following a step of detaching the coupler 82 from the operating member 69, a step of loosening the fastening tool 88, and a step of turning the coupler 82 about the fastening tool 88 inwardly, it is possible to withdraw the coupler 82 from the position between the operating member 69 and the linkage tool 27, and thereby leave the opening slot 10 open.

In consequence, the retainer member 15 attached to the upper part of the leg column 9 can be detached with use of a tool inserted through the opening slot 10, wherefore the broken leg column 9 can be removed from the support main body 8 for replacement or repair.

As shown in FIGS. 2, 3, 6, and 11, disposed between the upper parts of the paired operating members 69 is operating means 93 for simultaneous manual operation of the paired operating members 69. The operating means 93 comprises: an engagement portion 94 provided in each operating member 69; and an operating rod 96 having a linkage portion 95 which engages the engagement portion 94 of each of the right-hand and left-hand operating members 69.

The engagement portion 94 is formed in an engagement body 98 constructed independently of the operating member 69. An attachment portion 101 bent in an L-shaped configuration and the engagement portion 94 protruding horizontally inwardly from the attachment portion 101 are integral to form the engagement body 98. The attachment portion 101 comprises: a vertical wall 103; and a horizontal wall 104 protruding horizontally outwardly from the upper end of the vertical wall 103. The engagement portion 94, which protrudes horizontally inwardly from the horizontal wall 104, comprises: a pair of front and rear engagement pieces 107; and a horizontal plate-shaped coupling wall 108 providing a connection between the lower parts of the front and rear engagement pieces 107. The engagement piece 107 is tapered, or equivalently shaped so that its upper face extends horizontally inwardly at a downward incline, and that its vertical width decreases gradually toward the inward end in the horizontal direction.

The attachment portion 101 is disposed so that the vertical wall 103 stays along the horizontally inward face of the operating member 69, and the horizontal wall 104 engages the upper end of the operating member 69 from above. In this state, the attachment portion 101 is secured to the upper part of the operating member 69 by the fixing tool 22 such as a rivet.

The described operating rod 96 in the form of a horizontally-elongated prismatic tube is placed inside the recess 19 of the uppermost rung member 6*c* so as to be horizontally oriented parallel to the direction of length of the rung member 6*c*, and can thus be manually operated from below the rung member 6*c*. Each end of the operating rod 96 in the horizontal direction serves as the linkage portion 95 which is exteriorly fitted to the corresponding engagement portion 94 of the operating member 69, whereby the operating rod 96 is coupled to the right-hand and left-hand operating members 69. The right-hand and left-hand linkage portions 95 engage the engagement portions 94 of the right-hand and left-hand operating members 69, respectively, and, the upward movement (the movement in the unlocking direction) of the operating rod 96 allows concurrent upward movements of the right-hand and left-hand operating members 69, thus unlocking the right-hand and left-hand locking mechanisms 7.

A play a1, a2 is left between the linkage portion 95 at each of the right and left ends of the operating rod 96 and the engagement portion 94 corresponding to that linkage portion 95 in the vertical direction. When the operating rod 96 is out of operation, the linkage portion 95 rests on the engagement portion 94, wherefore a large lower play a1 only but no upper play a2 is created. When raising one of the right and left ends of the operating rod 96 alone, the corresponding linkage portion 95 moves upward by a distance equivalent to the dimensions of the lower play a1, engages the engagement portion 94, and moves further upward to lift the engagement portion 94. At this time, the operating rod 96 is inclined with one of its right and left ends alone rising upwardly. At the other end of the operating rod 96, in the presence of the large lower play a1 left between the linkage portion 95 and the engagement portion 94, the engagement portion 94 at the other end is restrained against upward movement.

That is, when one of the linkage portions 95 of the operating rod 96 is moved in the unlocking direction (upward direction) in engagement with the engagement portion 94, the other one of the linkage portions 95 of the operating rod 96 is removed from engagement with the engagement portion 94. Thus, by pressing one of the right and left ends (linkage portions 95) of the operating rod 96 into upward movement, the operating rod 96 is inclined upwardly to the right or left in the presence of the play a1, a2 with consequent upward movement of one of the operating members 69. This makes it possible to unlock one of the right-hand and left-hand locking mechanisms 7 alone.

According to the first embodiment thus far described, in effecting simultaneous telescoping adjustment of the right-hand and left-hand supports 5 under the condition where the locking member 23 is in engagement with the retention portion 11 of the leg column 9 and the right-hand and left-hand leg columns 9 are each locked against movement relative to the support main body 8 as shown in FIG. 4, by pressing the midportion of the operating rod 96 in the horizontal direction upward with operator's fingers inserted into the recess 19 of the uppermost rung member 6*c* from below, the right-hand and left-hand operating members 69 can be pulled in the unlocking direction (upward direction), thus causing the right-hand and left-hand linkage tools 27 to move from the locking position X to the unlocking position Y against the urgence exerted by the urging member 91. As an alternative, by operating each of the right-hand and left-hand handles 25 to rock about the pivot shaft 24 horizontally inwardly along the direction of arrow a with a grasp of the knob 48 of the handle cover 47, each of the right-hand and left-hand operation portions 42 pushes the cam faces 61*a* upward, thus causing the linkage tool 27 to move from the locking position X to the unlocking position Y against the urgence exerted by the urging member 91.

Then, in each of the right-hand and left-hand locking mechanisms 7, when the linkage tool 27 is moved from the locking position X to the unlocking position Y, due to the presence of the idle clearance 65 left between the second press-moving piece 59 and the operation piece 55, at first, the restraint portion 60 is displaced from the position of confrontation with the pressing portion 54 in response to the upward movement of the linkage tool 27, whereupon the locking member 23 becomes free of disengagement restraint by the disengagement preventive means 30 and is thus allowed to rock for disengagement. After that, the second press-moving piece 59 presses the operation piece 55 into upward movement, thus causing the locking member 23 to start to rock in the disengaging direction for disengagement. When the linkage tool 27 reaches the unlocking position Y, the disengagement of the locking member 23 from the retention portion 11 of the leg column 9 is completed. In consequence, each of the right-hand and left-hand leg columns 9 becomes movable relative to the support main body 8 for telescopic motion of the support 5.

In order for each of the right-hand and left-hand leg columns 9 to be locked against movement relative to the support main body 8 after the telescopic motion of the support 5, by releasing the upward pressing force acting upon the operating rod 96 or by bringing the rocking operation of each of the right-hand and left-hand handles 25 to a stop, the operating member 69, the linkage tool 27, and their included components are moved downward under the urgence exerted by the urging member 91, thus causing the right-hand and left-hand linkage tools 27 to move from the unlocking position Y to the locking position X.

When the linkage tool 27 is moved from the unlocking position Y to the locking position X, at first, the restraint portion 60 presses the pressing portion 54 into downward movement to rock the locking member 23 in the engaging direction. After that, the first press-moving piece 58 presses the operation piece 55 into downward movement, and, when the linkage tool 27 reaches the locking position X, the rocking motion of the locking member 23 in the engaging direction (the movement of the locking member 23 in a direction to be ready for locking operation) is completed.

Moreover, when the right-hand and left-hand linkage tools 27 are each moved to the locking position X, the pressing portion 54 and the restraint portion 60 confront each other, whereby the disengagement preventive means 30 prevents the locking member 23 from rocking in the disengaging direction. In consequence, the locking member 23 engages the retention portion 11 of the leg column 9, thus locking the leg column 9 against movement relative to the support main body 8. Besides, the action of the disengagement preventive means 30 to prevent rocking motion of the locking member 23 in the disengaging direction makes it possible to avoid accidental telescoping movement of the leg column 9 relative to the support main body 8 without fail.

Hence, when the right-hand and left-hand linkage tools 27 are each moved to the locking position X, the linkage means 29 brings the locking member 23 into engagement with the leg column 9, and, at the same time, the disengagement preventive means 30 prevents the locking member 23 from being accidentally removed from engagement with the leg column 9. Besides, when the linkage tool 27 goes out of the locking position X, the disengagement preventive means 30 permits the locking member 23 to rock for disengagement. That is, with the movement of the linkage tool 27 from the locking position X to the unlocking position Y and vice versa, the locking member 23 can be readily operated to change from a leg column 9-engaged state to a leg column 9-disengaged state and vice versa, thus facilitating telescoping adjustment operation.

On the other hand, in effecting telescoping adjustment of the support main body 8 of one of the right-hand and left-hand supports 5 alone, by pressing one end of the operating rod 96 in the horizontal direction upward with operator's fingers inserted into the recess 19 of the uppermost rung member 6*c* from below, the one end of the operating rod 96 in the horizontal direction alone is moved upward, and, corresponding one of the right-hand and left-hand operating members 69 is pulled in the unlocking direction (upward direction), thus causing corresponding one of the linkage tools 27 to move from the locking position X to the unlocking position Y against the urgence exerted by the urging member 91. As an alternative, by operating one of the right-hand and left-hand handles 25 to rock about the pivot shaft 24 horizontally inwardly along the direction of arrow a with a grasp of the knob 48 of the handle cover 47, corresponding one of the operation portions 42 pushes the cam faces 61*a* upward, thus causing the linkage tool 27 to move from the locking position X to the unlocking position Y against the urgence exerted by the urging member 91. In consequence, only one of the locking mechanisms 7 is unlocked to permit telescopic motion of corresponding one of the supports 5. Thus, telescoping adjustment of one of the supports 5 alone can be achieved with ease.

Hence, an operator is able to carry out unlocking operation using the operating rod 96 standing up. By manipulating the midportion of the operating rod 96 in the unlocking direction, the operating rod 96 as a whole can be moved in the unlocking direction for concurrent movements of the paired operating members 69 in the unlocking direction, thus unlocking the paired locking mechanisms 7 for concurrent telescoping movements of the paired supports 5. Thus, simultaneous telescoping adjustment of the paired supports 5 can be achieved with ease.

Moreover, in the presence of the play a1, a2 between the linkage portion 95 at each end of the operating rod 96 and the engagement portion 94, when manipulating one end of the operating rod 96 in the unlocking direction, the one end of the operating rod 96 is moved in the unlocking direction, and the other end of the operating rod 96 becomes free of restraint in the play a1, a2 in a disengaged state while moving within the range of the play a1, a2. As the operating rod 96 is inclined upwardly to the right or left, one of the operating members 69 alone is moved in the unlocking direction, whereas the other will no longer be moved in the unlocking direction, with the consequence that one of the locking mechanisms 7 is unlocked, whereas the other is kept locked.

Thus, only one of the supports 5 is allowed to telescope, wherefore telescoping adjustment of one of the supports 5 alone can be achieved with ease. Hence, for example, when placing the stepladder 1 on a slant or uneven ground surface, the paired supports 5 can be adjusted to telescope into different lengths with ease, wherefore the stepladder 1 can be set even on a slant or uneven ground surface quickly with stability.

Moreover, the arrangement of the operating member 69 along the outer face of the support main body 8 precludes the possibility that the locking mechanism 7 or the operating member 69 will constitute an obstruction to usage of the stepladder 1. Furthermore, since the locking mechanism 7 and the operating member 69 are arranged externally of the leg column 9, it is possible to construct the leg column 9 in tubular form, and thereby afford an advantage in strength. In addition, the locking member 23 can be readily operated to change from the leg column 9-engaged state to the leg column 9-disengaged state and vice versa from a location remote from the locking mechanism 7 with use of the operating member 69.

Figure 13:
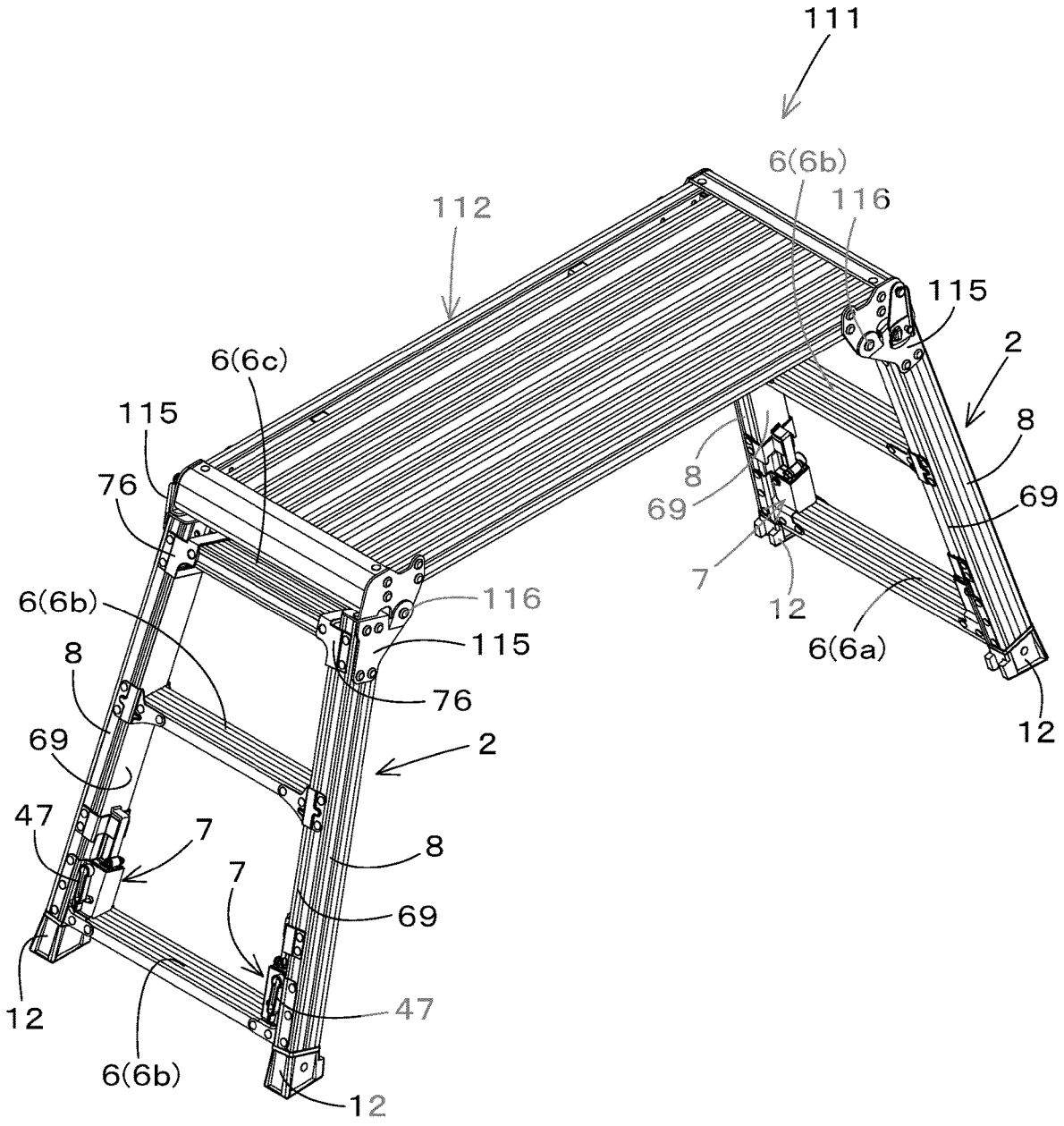
FIG. 13 is a general perspective view of the second embodiment, illustrating the telescopic device of the present invention embodied in a working stool.
Figure 14:
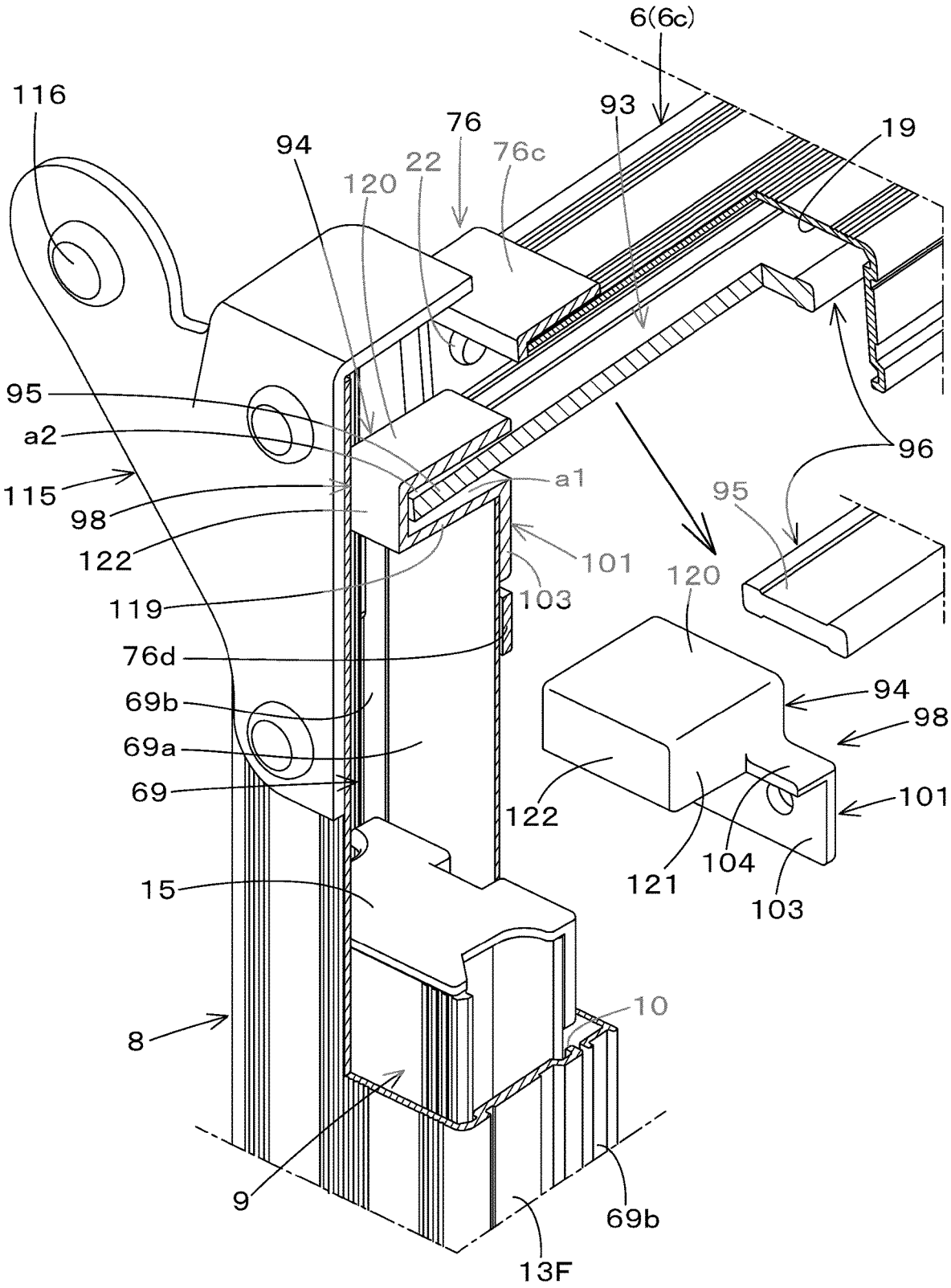
FIG. 14 is a perspective view, partly in section, of the upper part of the support and the operating means.

FIGS. 13 and 14 are drawings of the second embodiment, illustrating the telescopic device of the present invention embodied in a footstool 111. The footstool 111 shown in FIGS. 13 and 14 is mainly composed of a pair of opposed ladders 2 and a top plate 112, the ladder 2 being pivotally connected via corresponding one of paired right-hand and left-hand brackets 115 at its top to each end of the top plate 112 by a pin 116. The footstool 111 can be put into service by turning each of the paired ladders 2 about the pin 116 for unfoldment and setting the unfolded ladders 2 on the ground surface, and can be stored in place by folding and locking the paired ladders 2 against movement.

As is the case with the first embodiment, the ladder 2 comprises: a pair of telescoping supports (telescoping bodies) 5; a plurality of rung members (crosspiece members) 6 each providing a connection between the right-hand and left-hand supports 5; and a locking mechanism 7 situated between the support 5 and the rung member 6. Moreover, the paired supports (telescoping bodies) 5 are coupled in spaced relation to each other via the rung members (crosspiece members) 6. A support main body (outer casing) 8 of each of the paired supports 5 is provided with a locking mechanism 7 and an operating member 69. Disposed between the paired operating members 69 is operating means 93 for simultaneous manual operation of the paired operating members 69. The operating means 93 comprises: an engagement portion 94 provided in each operating member 69; and an operating rod 96 having a linkage portion 95.

As contrasted to the case with the first embodiment, the engagement portion 94 is shaped in a horizontally inwardly-opening bottomed prismatic tube comprising: a bottom wall 119; an upper wall 120; a pair of front and rear side walls 121; and a blocking wall 122 located at the horizontally outward end of the engagement portion 94.

The operating rod 96 in the form of a horizontal plate is placed inside a recess 19 of the uppermost rung member 6*c* so as to be horizontally oriented parallel to the direction of length of the rung member 6. Each of the right and left ends of the operating rod 96 serves as the linkage portion 95 which is loosely fitted into the engagement portion 94 of the operating member 69. Thus, the operating rod 96 can be manually operated from below the rung member 6*c*. The right-hand and left-hand linkage portions 95 engage the engagement portions 94 of the right-hand and left-hand operating members 69, respectively, and, the upward movement of the operating rod 96 allows concurrent upward movements of the right-hand and left-hand operating members 69, thus unlocking the right-hand and left-hand locking mechanisms 7.

Plays a1 and a2 are left between the linkage portion 95 at each of the right and left ends of the operating rod 96 and the engagement portion 94 corresponding to the linkage portion 95. When one of the linkage portions 95 of the operating rod 96 is moved in the unlocking direction (upward direction) in engagement with the engagement portion 94, the other one of the linkage portions 95 of the operating rod 96 is removed from engagement with the engagement portion 94.

The described operating rod 96 of the second embodiment is made as a plate in strip form for occurrence of vertical flexure thereacross, wherefore both simultaneous operation of the right-hand and left-hand operating members 69 and operation of one of the operating members alone can be achieved without the necessity of formation of a clearance (play a1, a2) between the linkage portion 95 and the engagement portion 94 in prismatic tube form.

Figure 15:
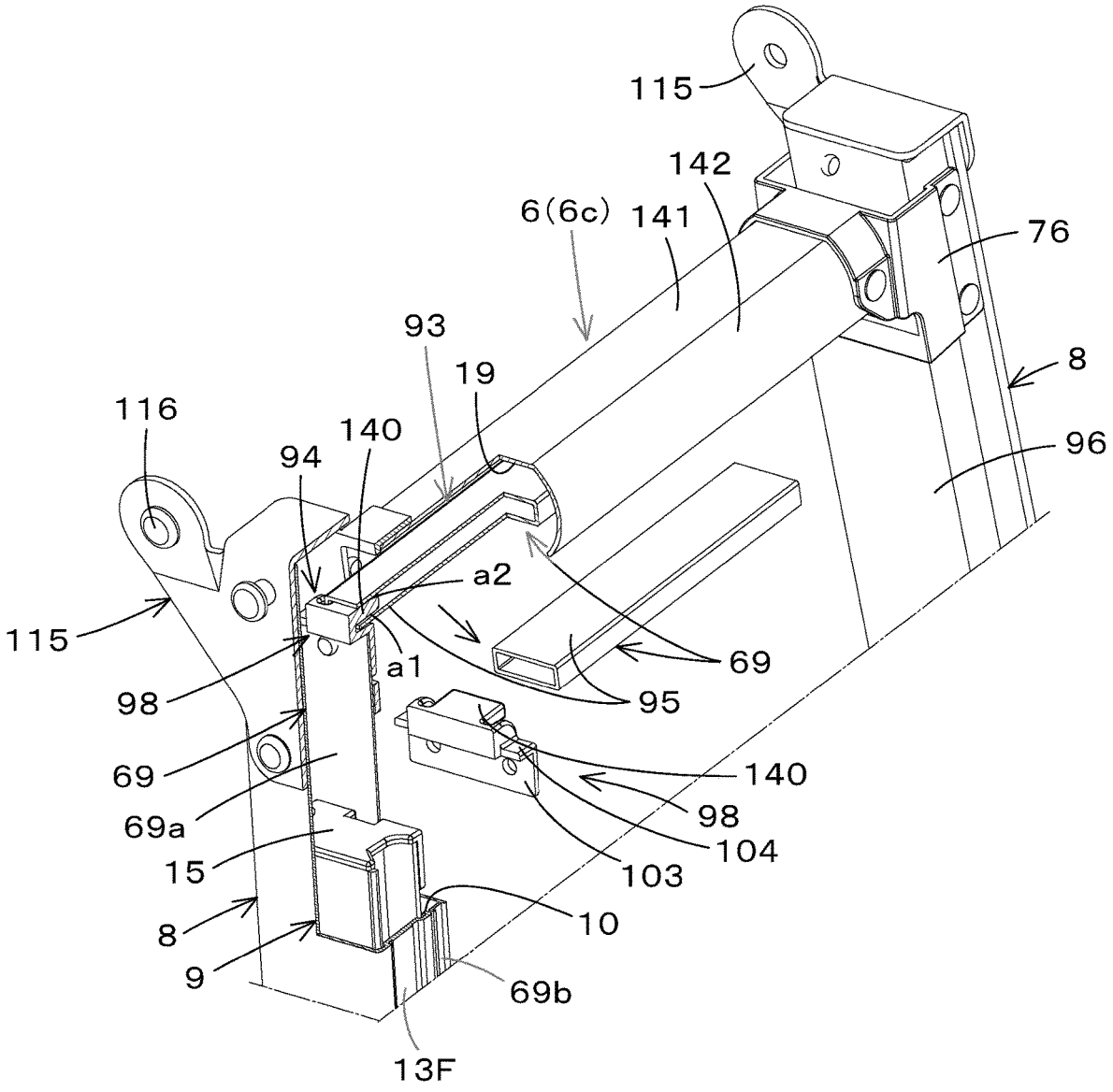
FIG. 15 is a perspective view, partly in section, of the third embodiment, illustrating the upper part of the support and the operating means of the telescopic device of the present invention embodied in a working stool.
Figure 16:
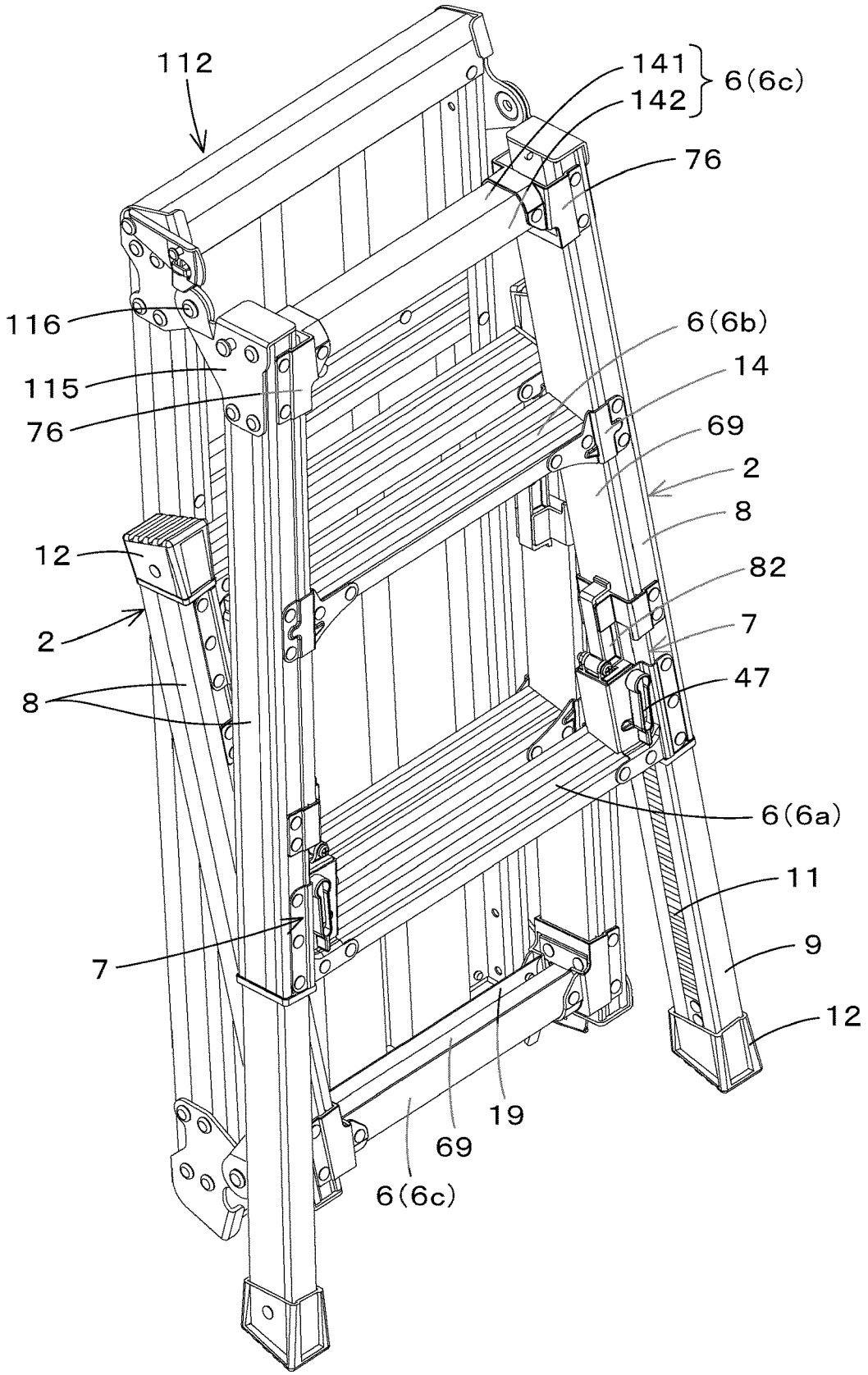
FIG. 16 is a perspective view of the working stool in folded and upstanding condition in accordance with the third embodiment of the present invention.

FIGS. 15 and 16 are drawings of the third embodiment, illustrating the telescopic device of the present invention embodied in a footstool 111. The footstool 111 differs from the footstool 111 of the second embodiment in the structures of the operating means 93 and the uppermost rung member 6.

The operating means 93 for simultaneous manual operation of the paired operating members 69 comprises: an engagement body 98 disposed at the upper part of each of the paired operating members 69; and an operating rod 96 providing a connection between the right-hand and left-hand engagement bodies 98. The operating rod 96 is constructed of a square pipe having a substantially rectangular sectional profile, and, a linkage portion 95 at each of the right and left ends of the operating rod 96 is loosely fitted to a tongue 140 of the engagement body 98. A clearance (play a1, a2) which appears in the vertical direction is left between the linkage portion 95 and the tongue 140 kept in engagement with each other.

The uppermost rung member 6 (6*c*), which is a hollow, open-bottomed member with a recess 19 in which is placed the operating means 93, comprises a flat top plate portion 141 and an arcuate plate portion 142 bent from each of the front and rear ends of the top plate portion 141.

The uppermost rung member 6, being located near both ends of the top plate 112 when the footstool 111 is set in service position, does not necessarily have to serve as a rung, and is hence given a substantially circular sectional profile to provide an easy grip for human hands. Thus, an operator is able to put his/her palms on the top plate portion 141 to catch the operating rod 96 with his/her fingers for its lift.

As shown in FIG. 16, the footstool 111 becomes folded for portability by folding one of the ladders 2 to let it rest alongside the top plate 112, and then folding the other to let it rest alongside the top plate 112 while overlying the one ladder 2.

The footstool 111 in the folded state is placed on a ground surface with one end of the top plate 112 (the end thereof coupled to the lower folded ladder 2) facing downward. Then, by manipulating the operating rod 96 of the operating means 93 of the upper folded ladder 2 coupled to the other end of the top plate 112 in the unlocking direction, the paired locking mechanisms 7 of the upper folded ladder 2 can be unlocked at one time, thus enabling the leg columns 9 of the right-hand and left-hand supports 5 to telescope for the placement of the ground-mounted members 12 on the ground surface.

In this state, by interrupting the manipulation of the operating rod 96 to lock the locking mechanism 7, it is possible to set the footstool 111 in upstanding condition with one end of the top plate 112 and the leg columns 9 of the upper folded ladder 2 placed on the ground surface.

That is, the outer casing (support main body) 8 of the ladder 2 is made smaller in length than the top plate 112, and, the insertion body (leg column) 9 can be held securely in a position where it is telescopically extended out of the outer casing 8 via the locking mechanism 7 in a manner such that the dimension of the insertion body 9 corresponding to the distance between the pin 116 to the front end of the insertion body 9 is substantially equal to the dimension of the top plate 112 corresponding to the distance between the pin 116 at one end of the top plate 112 to the other end thereof. By setting the folded footstool 111 so as to stand vertical while telescopically extending the right-hand and left-hand leg columns 9 at one time with the operating rod 96 situated thereabove, the footstool 111 can be maintained in storage position.

Figure 17:
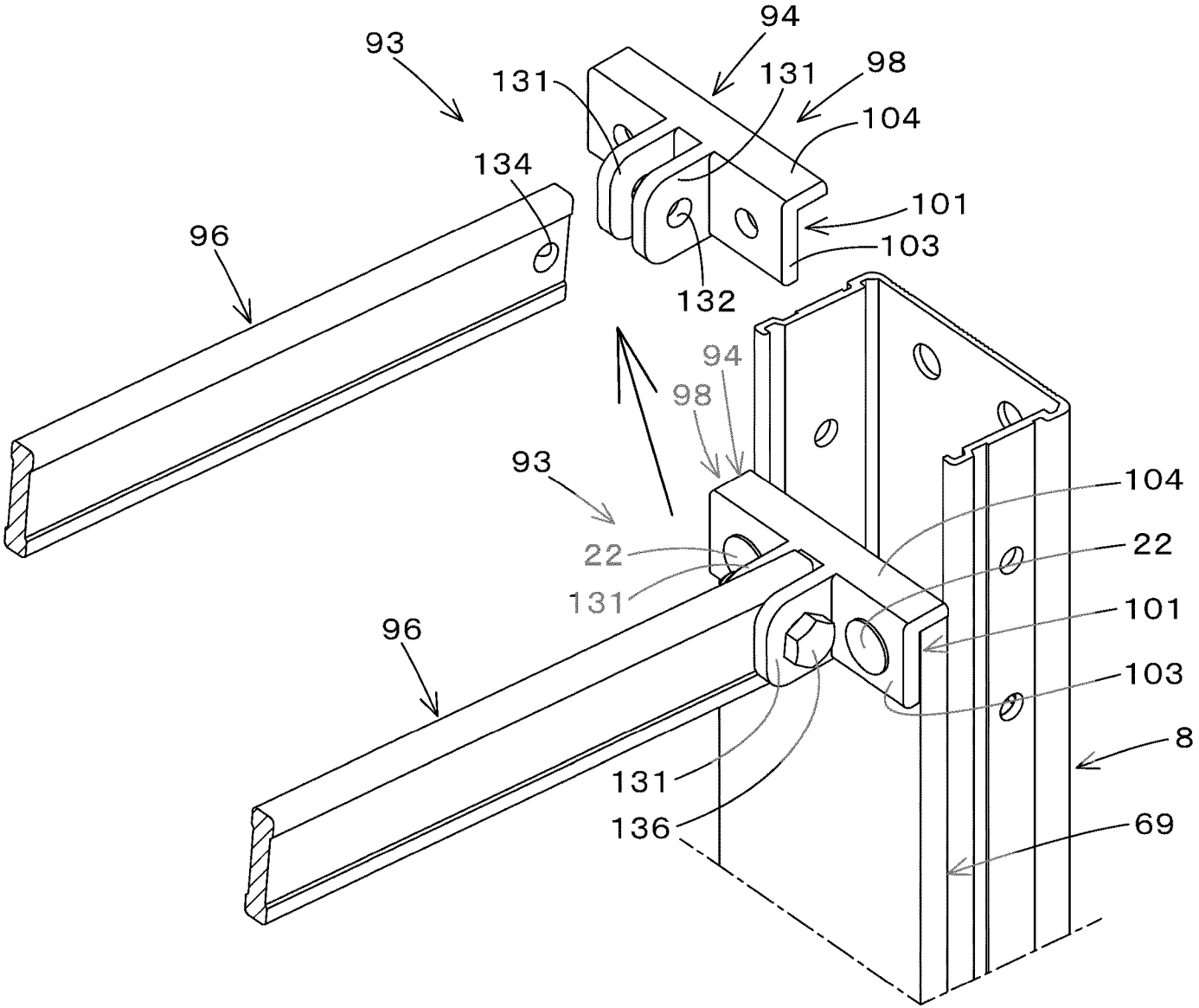
FIG. 17 is a perspective view of the upper part of the support and the operating means of the fourth embodiment of the present invention.

FIG. 17 is a drawing showing the fourth embodiment in which the operating means 93 for simultaneous manual operation of the paired operating members 69 comprises: an engagement body 98 disposed at the upper part of each of the paired operating members 69; and an operating rod 96 providing a connection between the right-hand and left-hand engagement bodies 98. The operating rod 96 is shaped in a plate having a sectional profile defined by the letter "I", and, the right and left ends of the operating rod 96 are engageably coupled to the paired operating members 69, respectively, via the engagement bodies 98.

An attachment portion 101 bent in an L-shaped configuration to define a vertical wall 103 and a horizontal wall 104, and a pair of front and rear coupling pieces 131 protruding horizontally inwardly from the attachment portion 101 are integral to form the engagement body 98. As is the case with the preceding embodiment, the attachment portion 101 is secured to the upper part of the operating member 69 by a fixing tool 22 such as a rivet.

Each of the front and rear coupling pieces 131 is formed with an attachment hole 132, and, each of the right and left ends of the operating rod 96 has an attachment hole 134 formed in corresponding relation to the attachment hole 132. After each of the right and left ends of the operating rod 96 is fitted in between the front and rear coupling pieces 131, a coupling tool 136 such as nut-and-bolt fastening means is inserted through the attachment holes 132 and 134 to couple each of the right and left ends of the operating rod 96 to the front and rear coupling pieces 131. At least one of the attachment holes 132 and 134 is made as an unloaded hole or a vertically-elongated slot to leave a clearance (play a1, a2) in the vertical direction relative to the coupling tool 136.

In response to the upward movement (the movement in the unlocking direction) of the operating rod 96, the right-hand and left-hand operating members 6 are pulled upwardly at one time, thus unlocking the right-hand and left-hand locking mechanisms 7. Moreover, when moving one end of the operating rod 96 in the unlocking direction (upward direction), the clearance between the coupling tool 136 and the attachment hole 134 at each of the right and left ends of the operating rod 96, the clearance between the coupling tool 136 and the attachment hole 132 of the coupling piece 131, and horizontally inward flexural deformation of the paired operating members 69 compensate for the movement of the other end of the operating rod 96 in the unlocking direction (upward direction) for restraint of movement. Then, the operating rod 96 is inclined upwardly to the right or left, thus causing one of the operating members 69 alone to move upward. This makes it possible to unlock one of the right-hand and left-hand locking mechanisms 7 alone.

That is, the engagement between each of the right and left ends of the operating rod 96 and corresponding one of the paired operating members 69 is such that, when manipulating one end of the operating rod 96 in the unlocking direction, the operating rod 96 is inclined with consequent movement of one of the operating members 69 alone in the unlocking direction.

As is the case with the preceding embodiment, the operating rod 96 is placed inside the recess 19 of the uppermost rung member 6*c* so as to be horizontally oriented parallel to the direction of length of the rung member 6*c*, and can thus be manually operated from below the rung member 6*c*.

It is noted that the application of the present invention is not limited to the embodiments as described heretofore. Although the embodiments have been described with respect to cases where the telescopic device is applied to the stepladder 1 and the footstool 111 each having the telescoping supports 5, the telescopic device is applicable also to a ladder or the like.

Moreover, the telescoping body is not limited to the support 5 comprising the support main body 8 and the leg column 9, but may be of any given construction comprising a tubular member capable of insertion of the leg column 9 for overall telescopic motion.

Moreover, in the described embodiments, when the linkage tool 27 is moved from the unlocking position Y to the locking position X, at first, the restraint portion 60 presses the pressing portion 54 into downward movement to rock the locking member 23 in the engaging direction, whereafter the first press-moving piece 58 presses the operation piece 55 into downward movement. As an alternative, the telescopic device may be designed so that, when the linkage tool 27 is moved from the unlocking position Y to the locking position X, the locking member 23 is rocked in the engaging direction solely by operating the first press-moving piece 58 to press the operation piece 55 into downward movement.

In another alternative, without providing the operating rod 96, the engagement portion 94 may be disposed in exposed condition below the recess 19 of the uppermost rung member 6*c*. In the telescopic device thereby constructed, the paired operating members 69 can be operated only on an individual basis.

EXPLANATION OF REFERENCE SYMBOLS

1 Stepladder (Telescopic device)
2 Ladder
5 Support (Telescoping body)
6 Rung member (Crosspiece member)
7 Locking mechanism
8 Support main body (Outer casing)
9 Leg column (Insertion body)
11 Retention portion
23 Locking member
24 Pivot shaft
25 Handle
69 Operating member
94 Engagement portion
95 Linkage portion
96 Operating rod
98 Engagement body
a1 Play
a2 Play
111 Footstool (Telescopic device)

The invention claimed is:

1. A telescopic device comprising:

a pair of telescoping bodies having a pair of opposed outer casings and insertion bodies that are telescopically inserted one in each of the outer casings, lower ends of the pair of telescoping bodies being groundable;

three rung members, including an upper rung member, a middle rung member and a lower rung member, coupled to opposing sides of the outer casings of the pair of telescoping bodies with lengthwise ends thereof confronting each other;

a locking mechanism arranged near a coupling position between each of the outer casings and the lower rung member, and securely holding corresponding one of the insertion bodies in a telescoped position; and operating means having a pair of operating members for locking and unlocking each of the locking mechanisms, the locking mechanism comprising a retention portion longitudinally disposed at the insertion body; and a locking member arranged near the coupling position between the outer casing and the lower rung member in movable relation toward and away from the retention portion for engagement with and disengagement from the retention portion of the insertion body, the operating members serving as a telescopic system close to the opposing side of the outer casing and being longitudinally arranged for a vertical movement, each of the operating members extending from the locking mechanism to a position near a coupling position between the outer casing and the upper rung member, and being formed at an upper part of the operating member with an upper end on which a force for vertically moving the operating member is exerted, one operating rod for giving a force for the vertical movement to the upper end of the operating member being arranged in a position lower than an upper face of the upper rung member and along the upper rung member, the upper rung member being constructed of an open-bottomed member with a recess having a substantially U-shaped sectional profile and downwardly opening on a lower side than the upper face over substantially its entire length, the operating rod being arranged inside the recess for vertical movement so as to be oriented parallel to a direction of length of the upper rung member, and being designed so as to be able to press and manually operate the operating rod into upward movement with human fingers inserted into the recess from below at both ends and an intermediate part of the upper rung member, and the upper ends of the paired operating member and both ends of the one operating rod being fitted to each other in a manner such that, when manipulating one end of the operating rod in an unlocking direction, the operating rod is inclined with consequent movement of one of the operating members alone in the unlocking direction, wherein the operating means comprises an engagement portion disposed at the upper end of each of the operating members and a linkage portion disposed at each end of the one operating rod in engageable relation to the engagement portion for engagement with and disengagement from the engagement portion, wherein, in between one of the linkage portions and the corresponding engagement portion at one end of the operating rod, as well as in between the other one of the linkage portions and the corresponding engagement portion at the other end of the operating rod, there is left a clearance serving as a play for movement of the linkage portion from a position out of engagement with the engagement portion to a position in engagement with the engagement portion in a vertical direction, and wherein when manipulating the one operating rod for upward movement over a whole length, the linkage portions on both sides are concurrently engageable with the engagement portions at both ends of the operating member.

2. The telescopic device according to claim 1, wherein:

the outer casing is made having a substantially U-shaped sectional profile, and a vertically long opening slot is formed on an opposing side of the outer casing, the insertion body is made having a substantially rectangular sectional profile inserted into the outer casing having the substantially U-shaped sectional profile, and an outer face of the insertion body in face-to-face relation to the opening slot is attached with the retention portion, an insertion space inserted with the operating member is formed between the opposing side of the corresponding outer casing and corresponding one of both longitudinal ends of the middle rung member, and the operating member is vertically oriented along the opening slot and piercingly through the insertion space, an upper guide member for restraining the upper part of the operating member from separating from the opposing side of the outer casing is disposed near the coupling position between the outer casing and the upper rung member, and a lower guide member for restraining a lower part of the operating member from separating from the opposing side of the outer casing is disposed near the coupling position between the outer casing and the lower rung member.

3. The telescopic device according to claim 1, wherein the locking mechanism comprises: a support frame secured to the outer casing for housing the locking member; a pivot shaft supported on the support frame to support the locking member for rocking motion in movable relation toward and away from the retention portion; a linkage tool arranged inside the support frame for vertically linear movement and interlocked to the operating member while being supported for movement between a locking position and an unlocking position; and an urging member for urging the linkage tool from the unlocking position toward the locking position, and wherein disposed between the locking member and the linkage tool are:

linkage means which engages the locking member with the retention portion and disengages the locking member from the retention portion for rocking motion when the linkage tool is vertically linearly moved from the locking position to the unlocking position, and disengagement preventive means which inhibits the locking member from rocking motion in a direction to disengage the locking member from the retention portion when the linkage tool is vertically linearly moved from the unlocking position to the locking position to engage the locking member with the retention portion, and permits the locking member to rock in a direction to disengage the locking member from the retention portion when the linkage tool is vertically linearly moved from the locking position to the unlocking position.

4. The telescopic device according to claim 3, wherein the linkage means comprises: an operation piece fainted in protrusion form in the locking member, the operation piece being pressed into movement in response to movements of the linkage tool to the locking position and to the unlocking position; and a first press-moving piece and a second press-moving piece, each formed in protrusion form in the linkage tool, arranged so as to have sandwiched therebetween the operation piece in a direction of movement of the linkage tool, the linkage means being designed so that, when the linkage tool is moved to the locking position, the first press-moving piece presses the operation piece into movement to rock the locking member in an engaging direction, whereas, when the linkage tool is moved to the unlocking position, the second press-moving piece presses the operation piece into movement to rock the locking member in a disengaging direction, wherein the disengagement preventive means comprises: a pressing portion disposed at a rocking end of the locking member so as to protrude toward the linkage tool; and a restraint portion disposed in the linkage tool so as to protrude toward the pressing portion, the disengagement preventive means being designed so that, when the linkage tool is vertically linearly moved to the locking position, the pressing portion and the restraint portion confront each other, whereas, when the linkage tool goes out of the locking position, the restraint portion is displaced from a position of confrontation with the pressing portion, and wherein an idle clearance is left between the second press-moving piece and the operation piece to allow the locking member to start to rock for disengagement after a removal of the restraint portion away from the pressing portion when the linkage tool is vertically linearly moved from the locking position to the unlocking position.

5. The telescopic device according to claim 3, wherein the locking member comprises a handle situated externally of the support frame to rock the locking member via the pivot shaft, wherein the handle comprises: a grip coupled at one end to the pivot shaft; and an operation portion extended from the other end of the grip toward the linkage tool, and wherein the linkage tool is provided with a cam wall for abutting while the operation portion is turning, and vertically linearly pressing the linkage tool into movement from the locking position to the unlocking position against an urgence exerted by the urging member by turning the handle about the pivot shaft.

6. The telescopic device according to claim 1, wherein two sets of components are arranged face to face each other, each set comprising: the paired telescoping bodies with the insertion bodies downwardly protruding from the outer casings and placed on a ground surface; the three rung members each providing a connection between the pair of outer casings; the locking mechanisms arranged near the coupling positions between the paired outer casings and both ends of the lower rung member; and the operating means having the operating member locking and unlocking each of the locking mechanisms and extending to a position near the upper rung member, wherein the two sets are foldably coupled to each other by foldably connecting their outer casings of the telescoping bodies to corresponding lengthwise ends of one flat top plate serving as a scaffold plate via a pin, wherein in the operation means, the one operating rod for individually or concurrently operating the paired operating members for movement is arranged inside the downwardly-opening recess of the upper rung member arranged at the upper parts of the telescoping bodies near both ends of the top plate, and the entire length of the operating rod is in a state of not being downwardly exposed from the upper rung member, and wherein downwardly telescopically extending amounts of four insertion bodies of the telescoping bodies from the outer casings are set on an individual basis in a manner such that the top plate becomes substantially horizontal.

7. The telescopic device according to claim 6, wherein the outer casing is made smaller in length than the top plate, and wherein the insertion body can be secured to the outer casing via the locking mechanism in a manner such that a dimension of the insertion body in a state of being telescopically extended out of the outer casing corresponding to a distance from the pin to a front end of the insertion body is substantially equal to a dimension of the top plate corresponding to a distance from the pin at an upper end of the top plate to a ground end thereof when setting the top plate so as to stand vertically.

8. The telescopic device according to claim 1, wherein a whole length of the operating rod is housed inside the downwardly-opening recess.

* * * * *